US010598077B2

(12) United States Patent
Kaneko et al.

(10) Patent No.: US 10,598,077 B2
(45) Date of Patent: Mar. 24, 2020

(54) CONTROL SYSTEM FOR INTERNAL COMBUSTION ENGINE

(71) Applicant: TOYOTA JIDOSHA KABUSHIKI KAISHA, Toyota-shi, Aichi-ken (JP)

(72) Inventors: Rihito Kaneko, Miyoshi (JP); Noboru Takagi, Toyota (JP); Isao Takagi, Okazaki (JP); Naoto Hisaminato, Toyota (JP); Mitsuru Yamaguchi, Nagoya (JP); Hirokazu Ando, Seto (JP); Hidetoshi Onoda, Toyota (JP); Hiroshi Akeyama, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 219 days.

(21) Appl. No.: 15/695,432

(22) Filed: Sep. 5, 2017

(65) Prior Publication Data

US 2018/0066567 A1 Mar. 8, 2018

(30) Foreign Application Priority Data

Sep. 7, 2016 (JP) ..... 2016-174616

(51) Int. Cl.

| | |
|---|---|
| ***F01P 7/16*** | (2006.01) |
| ***F01P 5/12*** | (2006.01) |
| ***F01P 7/14*** | (2006.01) |

(52) U.S. Cl.

CPC ..... *F01P 7/16* (2013.01); *F01P 5/12* (2013.01); *F01P 7/167* (2013.01); *F01P 2007/146* (2013.01); *F01P 2037/00* (2013.01)

(58) Field of Classification Search

CPC ..... F01P 7/16; F01P 7/167; F01P 5/12; F01P 2007/146; F01P 2037/00

See application file for complete search history.

(56) References Cited

U.S. PATENT DOCUMENTS

| | | | | |
|---|---|---|---|---|
| 5,095,855 | A | 3/1992 | Fukuda et al. | |
| 5,771,000 | A * | 6/1998 | Matsumoto | B60T 13/66 340/501 |
| 6,662,790 | B1 | 12/2003 | Kawamura et al. | |
| 6,679,201 | B2 | 1/2004 | Murakami et al. | |
| 2005/0245353 | A1* | 11/2005 | Scelers | F16H 61/12 477/127 |
| 2009/0265084 | A1* | 10/2009 | Enomoto | F02D 41/0055 701/112 |
| 2015/0370261 | A1* | 12/2015 | Yokoyama | F02D 41/1401 700/282 |

FOREIGN PATENT DOCUMENTS

| | | | |
|---|---|---|---|
| JP | 2767995 | B2 | 6/1998 |
| JP | 2000-303842 | A | 10/2000 |

(Continued)

*Primary Examiner* — Jacob M Amick
*Assistant Examiner* — Charles Brauch
(74) *Attorney, Agent, or Firm* — Oliff PLC

(57) ABSTRACT

An ECU includes a motor control unit that controls energization to a motor, and a fixation determination unit that makes a determination on fixation of a valve body. The motor drives the valve body housed in a housing of a control valve. When the fixation determination unit has determined that the valve body is fixed, the motor control unit performs fixation-time control that energizes the motor so as to drive the valve body.

18 Claims, 12 Drawing Sheets

(56) References Cited

FOREIGN PATENT DOCUMENTS

| | | | |
|---|---|---|---|
| JP | 2002-371848 | A | 12/2002 |
| JP | 2013-024188 | A | 2/2013 |
| JP | 2016-065517 | A | 4/2016 |
| JP | 2017-078341 | A | 4/2017 |
| WO | 02/014673 | A1 | 2/2002 |

* cited by examiner

CONTROL SYSTEM FOR INTERNAL COMBUSTION ENGINE

CROSS-REFERENCE TO RELATED APPLICATIONS

This application claims priority to Japanese Patent Application No. 2016-174616 filed on Sep. 7, 2016, which is incorporated herein by reference in its entirety.

BACKGROUND

1. Technical Field

The disclosure relates to a control system for an internal combustion engine.

2. Description of Related Art

Japanese Patent No. 2767995 discloses a cooling system for an internal combustion engine that circulates a cooling liquid through the inside of the internal combustion engine. Japanese Patent No. 2767995 also discloses a cooling system provided with a control valve that can change its opening degree and its discharge destination of a cooling liquid by rotating a valve body, disposed in a housing, by a motor.

SUMMARY

In such a control valve, it may happen that the valve body cannot be rotated relative to the housing due to foreign matter jammed between the housing and the valve body. In the case where such fixation of the valve body occurs, the control valve cannot be controlled to an intended state, and as a result, there is a possibility that the flow rate of the cooling liquid cannot be adequately controlled.

Therefore, the disclosure provides a control system for an internal combustion engine that prevents that the flow rate of a cooling liquid cannot be adequately controlled due to fixation of a valve body.

According to one aspect of the disclosure, there is provided a control system for an internal combustion engine, including an electronic control unit. The internal combustion engine is provided with a cooling system. The cooling system includes a pump and a control valve. The pump is configured to circulate a cooling liquid in a circulation path of the internal combustion engine. The control valve is configured to control the flow of the cooling liquid in the circulation path by driving a valve body housed in a housing, with a motor. The electronic control unit is configured to: (i) control energization to the motor, (ii) make a determination on fixation of the valve body, and (iii) perform fixation-time control that energizes the motor so as to drive the valve body, when the electronic control unit determines that the valve body is fixed.

According to the above-described configuration of the control system for the internal combustion engine, when it is determined that the valve body is fixed, the motor is energized, and therefore, if the valve body is driven to move even slightly, there is a possibility that foreign matter jammed between the housing and the valve body or jammed in gears between the valve body and the motor may come off. If the jammed foreign matter comes off in this way, the fixation of the valve body is eliminated, so that the control valve can be adequately controlled. Therefore, according to the above-described configuration, it can be prevented that the flow rate of the cooling liquid cannot be adequately controlled due to the fixation of the valve body.

In the above-described control system for the internal combustion engine, the electronic control unit may be configured to: (i) acquire an amount of movement of the valve body from a signal that is output from a sensor that detects a position of the valve body, and (ii) determine that the valve body is fixed based on fact that the amount of movement of the valve body for a predetermined time period is less than a reference value.

When the fixation is occurring, the amount of movement of the valve body for the predetermined time period becomes small. Therefore, according to the above-described configuration of the control system, by referring to the amount of movement of the valve body for the predetermined time period, it is possible to make a determination on the fixation of the valve body.

In the above-described control system for the internal combustion engine, the electronic control unit may be configured to determine that the valve body is fixed when a predetermined state is continued for a certain time period longer than the predetermined time period, and the predetermined state is a state in which the amount of movement of the valve body for the predetermined time period is less than the reference value.

The amount of movement of the valve body calculated from the signal that is output from the sensor may increase or decrease instantaneously due to the influence of noise. According to the above-described configuration of the control system, when the state where the amount of movement for the predetermined time period is less than the reference value is continued for the certain time period, a determination of the fixation is made. Therefore, it is possible to prevent an erroneous determination due to such an instantaneous change of the amount of movement.

In the above-described control system for the internal combustion engine, the electronic control unit may be configured to determine that the valve body is fixed when a predetermined state is continued for a certain time period longer than the predetermined time period, and the predetermined state is a state in which a torque of the motor is equal to or more than a predetermined amount and the amount of movement of the valve body for the predetermined time period is less than the reference value.

The torque by which the amount of movement of the valve body for the predetermined time period surely becomes greater than the reference value unless the fixation is occurring is set as the predetermined amount, and by adding the torque of the motor being equal to or more than the predetermined amount as the condition for determination of the fixation as described above, the determination of the fixation in the control system for the internal combustion engine is performed more strictly.

In the above-described control system for the internal combustion engine, the electronic control unit may be configured to: (i) acquire a signal that is output from a sensor that detects a position of the valve body, and perform feedback control that controls energization to the motor so as to cause the position of the valve body to coincide with a target position, and (ii) acquire a signal that is output from the sensor that detects the position of the valve body, to thereby acquire the position of the valve body, and determine that the valve body is fixed when a predetermined state is continued for a certain time period, and the predetermined state is a state in which a deviation between the target position in the feedback control and the position acquired from the signal that is output from the sensor is equal to or more than a reference amount.

When the fixation is occurring, the valve body does not easily move toward the target position. Accordingly, even when the feedback control is performed, the state where the target position and the position acquired from the signal output from the sensor deviate from each other continues. Therefore, even by the method, as the above-described configuration of the control system, that determines that the valve body is fixed when the state where the deviation between the target position in the feedback control and the position acquired from the signal that is output from the sensor is equal to or more than the reference amount is continued for the certain time period, it is possible to make a determination of the fixation of the valve body.

In the above-described control system for the internal combustion engine, the electronic control unit may be configured to control energization to the motor so as to produce a torque greater than a torque that is produced when the electronic control unit determines that the valve body is not fixed, in the fixation-time control.

When the fixation has occurred, the valve body does not easily move. Therefore, in order to move the valve body, that does not easily move, so as to cause the jammed foreign matter to come off, it is preferable, as the above-described configuration of the control system, to control energization to the motor so as to produce a torque greater than a torque that is produced when a determination of the fixation is not made. By employing such a configuration of the control system, the valve body tends to be moved by the fixation-time control even when the fixation is occurring, so that the fixation tends to be eliminated.

In the above-described control system for the internal combustion engine, the electronic control unit may be configured to control energization to the motor such that a time period during which energization to the motor is stopped to stop driving of the valve body and a time period during which the motor is energized to drive the valve body are repeated alternately, in the fixation-time control.

While the valve body continues to be driven, the force holding the foreign matter continues to act on the foreign matter via the gears, the valve body, and the housing. On the other hand, as the above-described configuration of the control system, by controlling energization to the motor such that the time period for stopping the driving of the valve body and the time period for driving the valve body are repeated alternately, the time period during which the force holding the foreign matter is relaxed and does not act is provided. As a result, the force holding the foreign matter changes periodically, so that the jammed foreign matter comes off more easily.

In the above-described control system for the internal combustion engine, the valve body may move in a first direction or a second direction opposite to the first direction in the housing. The electronic control unit may be configured to control energization to the motor such that driving of the valve body in the first direction and driving of the valve body in the second direction are performed alternately, in the fixation-time control.

By continuously driving the valve body in one direction or by repeating the driving in one direction, the foreign matter may further be jammed. On the other hand, according to the above-described configuration of the control system, since the driving in the first direction and the driving in the second direction are repeated alternately, there is a possibility that the foreign matter that did not easily come off when driving in one direction may come off when driving in the other direction. Therefore, the fixation tends to be eliminated.

In the above-described control system for the internal combustion engine, the valve body may move in a first direction or a second direction opposite to the first direction in the housing. When the electronic control unit starts the fixation-time control, the electronic control unit may be configured to control energization to the motor so as to drive the valve body in a direction that is opposite to a direction when the electronic control unit determines that the valve body is fixed, among the first direction and the second direction.

When the fixation has occurred due to jamming of the foreign matter between the valve body and the housing or in the gears between the valve body and the motor, even if energization to the motor is controlled so as to further drive the valve body in the driving direction when the fixation occurred, since the foreign matter is further jammed, there is a possibility that the fixation is not eliminated. On the other hand, by controlling energization to the motor as the above-described configuration of the control system, since the valve body is driven in the direction opposite to the driving direction when the foreign matter was jammed, the force holding the foreign matter is relaxed, so that the foreign matter tends to come off. Therefore, the fixation tends to be eliminated.

In the above-described control system for the internal combustion engine, the valve body may move in a first direction or a second direction opposite to the first direction in a predetermined range until abutting a stopper in the housing. The electronic control unit may be configured to: when the electronic control unit starts the fixation-time control and a distance from the valve body to the stopper in one of the first direction and the second direction is less than a predetermined distance, (i) control energization to the motor so as to drive the valve body in the other of the first direction and the second direction, in the fixation-time control, and (ii) control energization to the motor so as not to drive the valve body in the one of the first direction and the second direction, in the fixation-time control.

In the above-described control system for the internal combustion engine, the valve body may move in the first direction or the second direction opposite to the first direction in a predetermined range until abutting a stopper in the housing. The electronic control unit may be configured to: when the electronic control unit starts the fixation-time control and a distance from the valve body to the stopper in one of the first direction and the second direction is less than a predetermined distance, (i) not perform the process to control energization to the motor so as to drive the valve body in a direction that is opposite to a direction when the electronic control unit determines that the valve body is fixed, among the first direction and the second direction, and control energization to the motor so as to drive the valve body in the other of the first direction and the second direction, in the fixation-time control, and (ii) not perform the process to control energization to the motor so as to drive the valve body in a direction that is opposite to a direction when the electronic control unit determines that the valve body is fixed, among the first direction and the second direction, and control energization to the motor so as not to drive the valve body in the one of the first direction and the second direction, in the fixation-time control.

When the distance to the stopper is short, if the valve body is driven toward the stopper side in the fixation-time control, there is a possibility that the valve body that starts to move due to elimination of the fixation may collide with the stopper. According to the above-described configuration of the control system, in the case where the distance to the stopper is short when starting the fixation-time control, the valve body is not driven toward the stopper side in the fixation-time control, so that it is possible to avoid such a collision.

In the above-described control system for the internal combustion engine, the electronic control unit may be configured to: (i) acquire an amount of movement of the valve body from a signal that is output from a sensor that detects a position of the valve body, after the electronic control unit determines that the valve body is fixed, and (ii) determine that fixation of the valve body is eliminated when the amount of movement of the valve body for a predetermined time period becomes greater than a reference value.

When the fixation has been eliminated through the fixation-time control, since the valve body easily moves, the amount of movement of the valve body for the predetermined time period becomes large. Therefore, by referring to the amount of movement of the valve body for the predetermined time period, it is possible to determine that the fixation of the valve body is eliminated.

In the above-described control system for the internal combustion engine, the electronic control unit may be configured to: (i) acquire an amount of movement of the valve body from a signal that is output from a sensor that detects a position of the valve body, after the electronic control unit determines that the valve body is fixed, and (ii) determine that fixation of the valve body is eliminated when a predetermined state is continued for a certain time period longer than a predetermined time period, the predetermined state is a state in which the amount of movement of the valve body for the predetermined time period is greater than a reference value.

According to the above-described configuration of the control system, since it is determined that the fixation is eliminated when the state where the amount of movement for the predetermined time period is greater than the reference value is continued for the certain time period, it is possible to prevent an erroneous determination that is caused by an instantaneous change of the amount of movement due to noise or the like.

In the above-described control system for the internal combustion engine, the electronic control unit may be configured to end the fixation-time control when it is determined that the fixation of the valve body is eliminated. According to the above-described configuration of the control system, when the electronic control unit determines that the fixation is eliminated, the fixation-time control is immediately ended, and therefore, normal control can be quickly restarted to control the flow of the cooling liquid.

In the above-described control system for the internal combustion engine, the pump may be an engine-driven pump that is driven by an output shaft of the internal combustion engine. The electronic control unit may be configured to: (i) perform an output limitation process which limits an output of the internal combustion engine, and (ii) perform the output limitation process when the fixation-time control is being performed.

When the fixation of the valve body has occurred so that the state of the control valve can not be adequately controlled, there is a possibility that the pressure of the cooling liquid in the circulation path may become excessively high. For example, when the fixation has occurred in a state where the opening degree of the control valve is small, the amount of the cooling liquid that can pass through the control valve is in an extremely limited state. If, in this state, the rotational speed of the output shaft of the internal combustion engine is increased so that the amount of the cooling liquid discharged from the pump becomes large, there is a possibility that the pressure of the cooling liquid in the circulation path may become excessively high. In this regard, according to the above-described configuration of the control system, when it is determined that the valve body is fixed so that the fixation-time control is being performed, the output limitation process is performed, and therefore, the amount of the cooling liquid discharged from the pump is limited. Consequently, even when the fixation of the valve body is occurring, the pressure of the cooling liquid in the circulation path is prevented from becoming excessively high.

In the above-described control system for the internal combustion engine, the electronic control unit may be configured to: (i) start the output limitation process after a lapse of a predetermined time from start of the fixation-time control while the fixation-time control is being performed, and (ii) end the fixation-time control when the electronic control unit determines that fixation of the valve body is eliminated.

When the fixation-time control is performed, the fixation may be eliminated. According to the above-described configuration of the control system, the output limitation process is started after the lapse of the predetermined time from the start of the fixation-time control while the fixation-time control is being performed. Therefore, when the fixation is eliminated by the fixation-time control before the start of the output limitation process, the output limitation process is not performed. Accordingly, it can be prevented that the output limitation process is performed unnecessarily.

In the above-described control system for the internal combustion engine, the electronic control unit may be configured to: (i) acquire a position of the valve body from a signal that is output from a sensor that detects a position of the valve body, in the output limitation process, and (ii) limit the output of the internal combustion engine according to the position of the valve body when the electronic control unit starts the output limitation process.

According to the above-described configuration of the control system, the state of the control valve can be acquired according to the position of the valve body, and the output of the internal combustion engine can be limited according to the state of the control valve, and therefore, the output limitation process can be performed in an adequate manner in terms of suppressing a rise in pressure in the circulation path. As result, it is possible to prevent the pressure of the cooling liquid in the circulation path from becoming excessively high while preventing the output of the internal combustion engine from being unnecessarily limited.

In the above-described control system for the internal combustion engine, the electronic control unit may be configured to: (i) output a signal that causes a notification device, that notifies an abnormality of the control valve, to perform notification, and (ii) output a signal that causes the notification device to perform notification when the fixation-time control is continued for a certain time period.

According to the above-described configuration of the control system, when the fixation is not eliminated even when the fixation-time control is continued for the certain time period, an abnormality is notified, so that it is possible to prompt the maintenance. Further, in the above-described control system for the internal combustion engine, the electronic control unit may be configured to: (i) acquire a temperature of the cooling liquid, and (ii) not output the signal that causes the notification device to perform notification when the acquired temperature of the cooling liquid is a temperature indicative of freezing of the cooling liquid even when the fixation-time control is continued for the certain time period.

When the cooling liquid is frozen, there is a possibility that the valve body does not move even when foreign matter or the like is not jammed, so that it may be determined by the electronic control unit that the valve body is fixed. When the valve body does not move due to freezing, the fixation is eliminated following a rise in temperature of the internal combustion engine or in atmospheric temperature. If an abnormality is notified even in the case of the fixation due to freezing which may be eliminated following a rise in temperature of the internal combustion engine or in atmospheric temperature, the frequency of prompting the maintenance becomes unnecessarily high, resulting in lowering of reliability. On the other hand, according to the above-described configuration of the control system, since an abnormality is not notified when there is a possibility of the fixation due to freezing, the lowering of reliability described above can be prevented.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinbelow, an electronic control unit (hereinafter referred to as an "ECU") according to an embodiment as one example of a control system for an internal combustion engine will be described with reference to FIGS. 1 to 19. First, referring to FIG. 1, a cooling system for an internal combustion engine 1 will be described. The internal combustion engine 1 is an internal combustion engine that is mounted on a vehicle.

Figure 1:
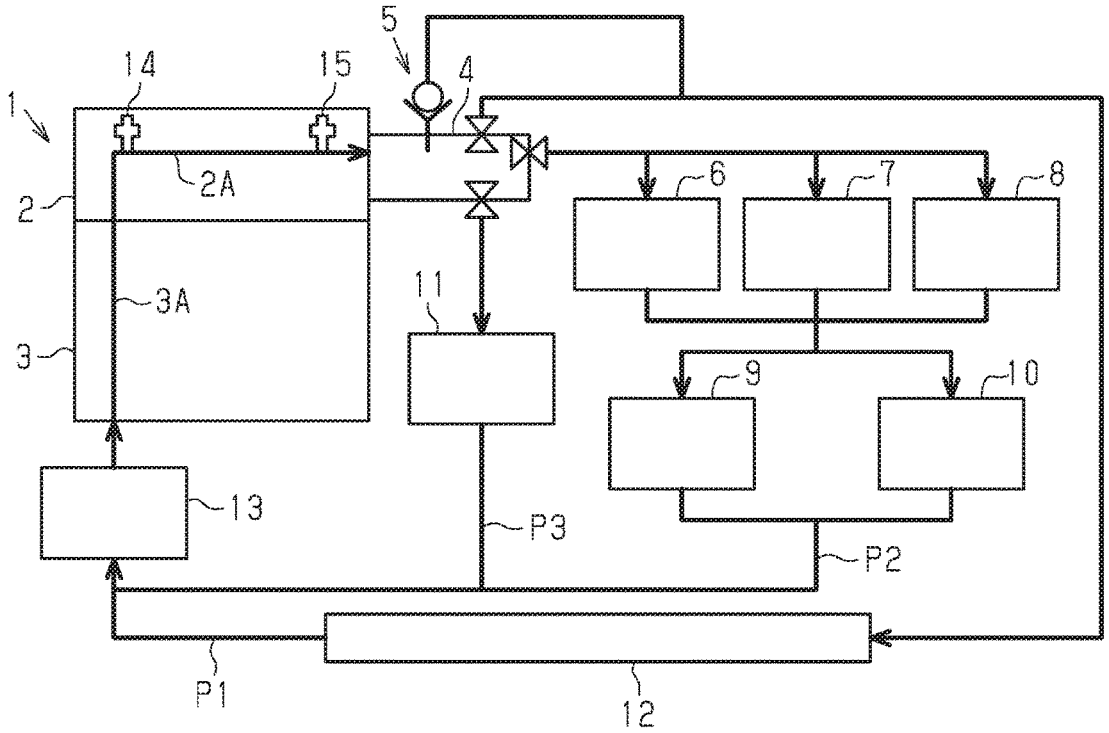
FIG. 1 is a schematic diagram exemplarily showing the configuration of a cooling system mounted on an internal combustion engine that is controlled by an electronic control unit (ECU) included in a control system for the internal combustion engine according to an embodiment as one example of the disclosure.

As shown in FIG. 1, in the internal combustion engine 1, a water jacket 3A that serves as part of a circulation path of a cooling liquid is provided in a cylinder block 3, and a water jacket 2A that serves as part of the circulation path of the cooling liquid is provided in a cylinder head 2.

A cooling liquid pump 13 is connected to a portion, upstream of the water jackets 3A and 2A, of the circulation path of the cooling liquid. Since the cooling liquid pump 13 is an engine-driven pump that is driven by a crankshaft of the internal combustion engine 1, the discharge amount of the cooling liquid from the cooling liquid pump 13 increases as the rotational speed of the crankshaft increases. The cooling liquid discharged from the cooling liquid pump 13 is introduced into the water jackets 3A and 2A.

A multi-way valve 4 as a control valve that switches the circulation path of the cooling liquid and controls the amount of the cooling liquid to be circulated is disposed at a portion where a cooling liquid outlet of the water jacket 2A is provided. A head liquid temperature sensor 14 that detects a temperature of the cooling liquid that has just flowed into the water jacket 2A from the water jacket 3A, and an outlet liquid temperature sensor 15 that detects a temperature of the cooling liquid that has passed through the water jacket 2A and is discharged into the multi-way valve 4 are disposed in the water jacket 2A.

The multi-way valve 4 has three discharge destinations of the cooling liquid. The first discharge destination of the cooling liquid is a first cooling liquid passage P1 that passes through a radiator 12. A portion, downstream of the radiator 12, of the first cooling liquid passage P1 is connected to the cooling liquid pump 13, so that the cooling liquid that has passed through the radiator 12 is returned to the cooling liquid pump 13.

The second discharge destination of the cooling liquid is a second cooling liquid passage P2 that circulates the cooling liquid through devices, such as a throttle body 6 and an EGR valve 7, disposed at portions of the internal combustion engine 1. The second cooling liquid passage P2 is first divided into three branches to supply the cooling liquid to the throttle body 6, the EGR valve 7, and an EGR cooler 8. Then, after once joining together downstream of the throttle body 6, the EGR valve 7, and the EGR cooler 8, the second cooling liquid passage P2 is divided into two branches to supply the cooling liquid to an oil cooler 9 and an ATF warmer 10. After joining together downstream of the oil cooler 9 and the ATF warmer 10, the second cooling liquid passage P2 is joined to the portion, downstream of the radiator 12, of the first cooling liquid passage P1.

The third discharge destination of the cooling liquid is a third cooling liquid passage P3 that circulates the cooling liquid through a heater core 11 of an air conditioner. A portion, downstream of the heater core 11, of the third cooling liquid passage P3 is joined to the second cooling liquid passage P2 at its portion downstream of its joint portion downstream of the oil cooler 9 and the ATF warmer 10 and upstream of its joint portion with the first cooling liquid passage P1.

As described above, the cooling liquid passages P1, P2, and P3 are finally joined together and connected to the cooling liquid pump 13. Therefore, the cooling liquid that has flowed through each of the cooling liquid passages P1, P2, and P3 is returned to the cooling liquid pump 13. Then, the cooling liquid returned to the cooling liquid pump 13 is delivered again to the inside of the internal combustion engine 1 by the cooling liquid pump 13.

The multi-way valve 4 is provided with a relief valve 5 that is opened to relieve the cooling liquid in the multi-way valve 4 into the first cooling liquid passage P1 when the pressure in the multi-way valve 4 becomes excessively high. Part of the first cooling liquid passage P1, such as a portion connecting a radiator port 401 and the radiator 12, is formed by a hose. The same applies to the second and third cooling liquid passages P2 and P3.

Figure 2:
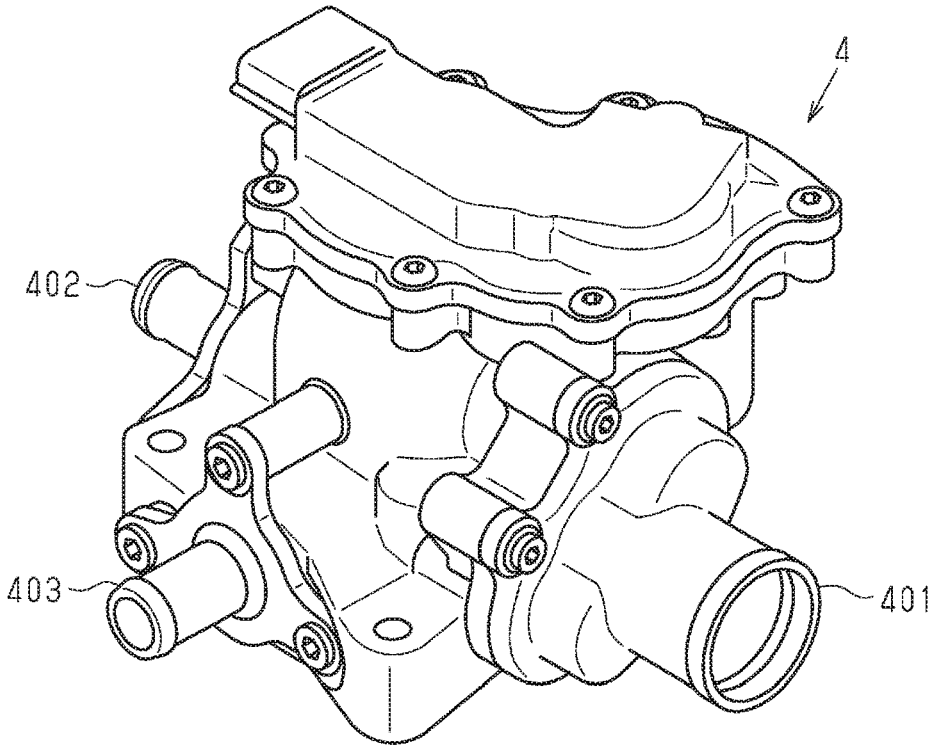
FIG. 2 is a perspective view of a multi-way valve that is controlled by the ECU included in the control system of the embodiment.

Next, referring to FIGS. 2 to 5, the structure of the multi-way valve 4 will be described. As shown in FIG. 2, the multi-way valve 4 has three ports 401, 402, and 403 that serve as cooling liquid outlets and are respectively disposed in different directions. The heater port 402 and the device port 403 have substantially the same inner diameter, while the inner diameter of the radiator port 401 is greater than those of the heater port 402 and the device port 403. The first cooling liquid passage P1 is connected to the radiator port 401, the third cooling liquid passage P3 is connected to the heater port 402, and the second cooling liquid passage P2 is connected to the device port 403.

Figure 3:
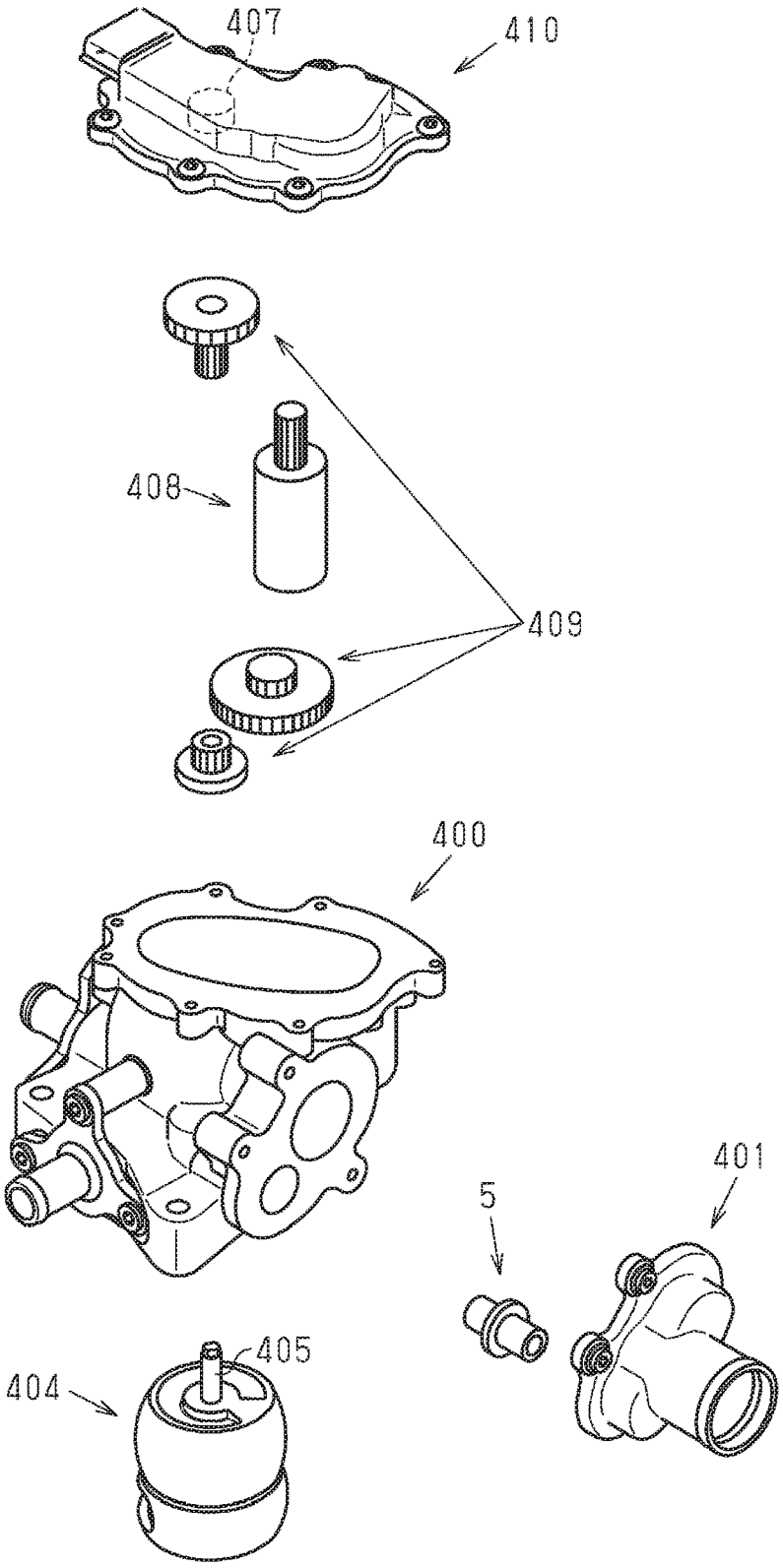
FIG. 3 is an exploded perspective view of the multi-way valve.

FIG. 3 shows part of components forming the multi-way valve 4. A housing 400 forms the framework of the multi-way valve 4 and has holes respectively communicating with the ports 401, 402, and 403. There are two holes communicating with the radiator port 401, and the relief valve 5 is housed in one of the holes. In this way, the radiator port 401 is attached to the housing 400 in the state where the relief valve 5 is housed in one of the holes. Consequently, the relief valve 5 is provided inside the radiator port 401. The reason for providing the relief valve 5 in the radiator port 401 among the three ports 401, 402, and 403 is that since the passage cross-sectional area of the radiator port 401 is greater than those of the heater port 402 and the device port 403, it is easier to ensure the relief amount.

Further, a valve body 404 is housed in the housing 400. The valve body 404 has a cooling liquid passage therein. Therefore, when the valve body 404 is rotated about a shaft 405 so that the relative angle of the valve body 404 to the housing 400 is changed, the degree of overlap between each of the holes of the housing 400 communicating with the ports 401, 402, and 403 and the cooling liquid passage in the valve body 404 is changed. As a result, the flow rate of the cooling liquid through each of the ports 401, 402, and 403 is changed.

Further, a motor 408 and gears 409 are housed in the housing 400. The shaft 405 of the valve body 404 is connected to the motor 408 via the gears 409. Accordingly, the rotational speed of the motor 408 is changed through the gears 409, so that the valve body 404 is rotated at a changed rotational speed. The reason for changing the rotational speed of the motor 408 through the gears 409 is that a large torque is required for rotating the valve body 404 filled with the cooling liquid. Therefore, the rotation of the motor 408 is reduced in speed through the gears 409 and transmitted to the valve body 404.

Further, a sensor cover 410 is attached to the housing 400 so as to cover a portion where the motor 408 and the gears 409 are housed. A position sensor 407 is attached to the inside of the sensor cover 410, and a leading end of the shaft 405 of the valve body 404 is fitted to a rotor of the position sensor 407. The position sensor 407 is a sensor that outputs a voltage in proportion to a rotation angle of its rotor. Therefore, when the valve body 404 is rotated in the housing 400, the rotor of the position sensor 407 is rotated along with the rotation of the valve body 404, so that a voltage corresponding to a relative angle between the valve body 404 and the housing 400 is output from the position sensor 407.

Figure 4A:
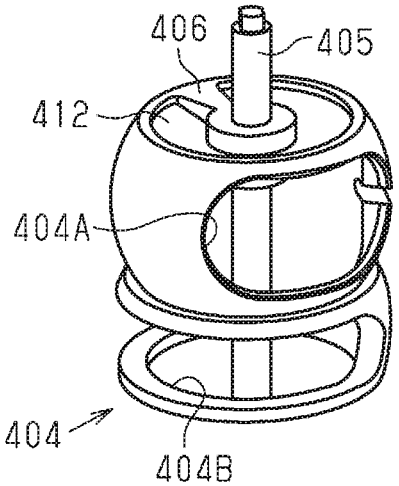
FIG. 4A is a perspective view of a valve body that is a component of the multi-way valve.
Figure 4B:
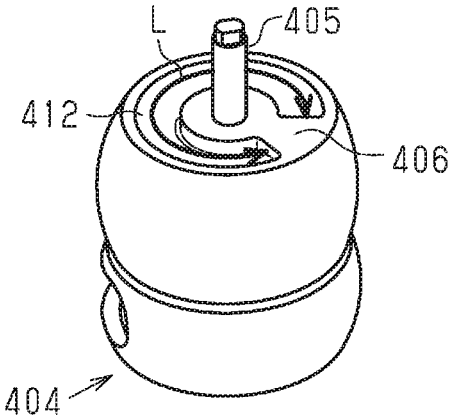
FIG. 4B is a perspective view of the valve body being the component of the multi-way valve when viewed from the 180-degree opposite side as compared with FIG. 4A.

FIGS. 4A and 4B show the valve body 404 of FIG. 3 in an enlarged scale. The valve body 404 has a shape such that two barrel-shaped objects are stacked one on top of the other, and is provided with the shaft 405 at the center.

As shown in FIG. 4A, the valve body 404 is formed, at side surfaces of its two barrel-shaped portions, with holes 404A and 404B through which the cooling liquid can pass. That is, the holes 404A and 404B form part of the cooling liquid passage provided in the valve body 404. The hole 404A communicates with the radiator port 401 when the valve body 404 is in a certain relative angle range with respect to the housing 400. On the other hand, the hole 404B communicates with at least one of the heater port 402 and the device port 403 when the valve body 404 is in another certain relative angle range with respect to the housing 400.

As shown in FIGS. 4A and 4B, the valve body 404 is formed at its upper surface with a groove 412 that extends to surround the base of the shaft 405 in such a way as to leave a portion as an engaging portion 406.

Figure 5:
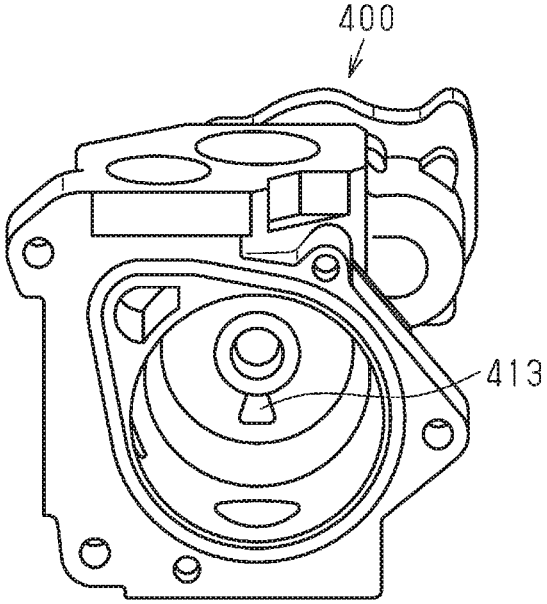
FIG. 5 is a perspective view of a housing that is a component of the multi-way valve.

FIG. 5 is a perspective view of the housing 400 when viewed in an insertion direction of the valve body 404. A stopper 413 is provided in the housing 400 such that the stopper 413 is received in the groove 412 when the valve body 404 is housed in the housing 400. When the valve body 404 is housed in the housing 400, the relative rotation of the valve body 404 with respect to the housing 400 is limited due to abutment of the engaging portion 406 of the valve body 404 against the stopper 413. That is, it is configured that the valve body 404 can be rotated relative to the housing 400 within a range where the stopper 413 moves in a range indicated by an arrow L in FIG. 4B.

The multi-way valve 4 configured as described above is fixed to the cylinder head 2 of the internal combustion engine 1 such that its housing hole portion shown in FIG. 5 into which the valve body 404 is inserted is overlapped with a cooling liquid outlet portion of the cylinder head 2.

Consequently, it is configured that the cooling liquid flows into the multi-way valve 4 from an opening of its housing hole portion.

Figure 6:
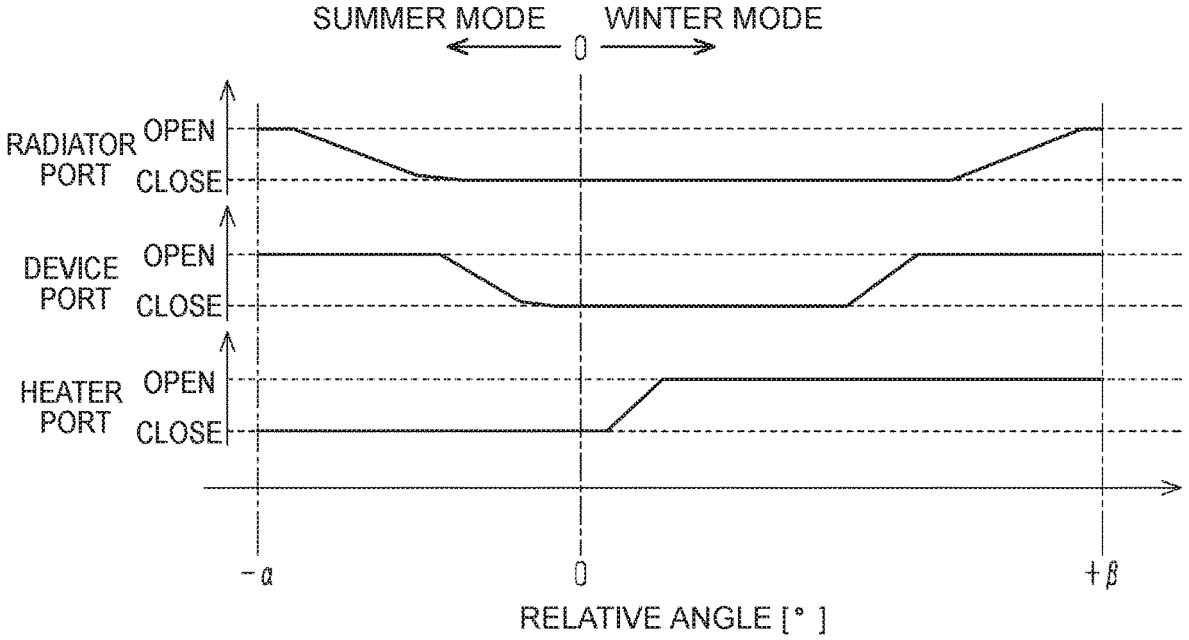
FIG. 6 is a graph showing the relationship between a relative angle of the valve body to the housing of the multi-way valve and opening degrees of respective ports.

FIG. 6 is a graph showing the relationship between a relative angle of the valve body 404 to the housing 400 of the multi-way valve 4 and opening degrees of the ports 401, 402, and 403. As shown in FIG. 6, the multi-way valve 4 is configured such that, given that its position where all the ports 401, 402, and 403 are in a fully closed state is defined as a position of relative angle "0 [°]", the valve body 404 can be rotated in either a plus direction or a minus direction to a position where the stopper 413 of the housing 400 and the engaging portion 406 of the valve body 404 abut against each other. That is, in the multi-way valve 4, the state where all the ports 401, 402, and 403 are fully closed, i.e. the state of opening degree "0", is the minimum opening degree.

The sizes and positions of the holes 404A and 404B of the valve body 404 are set such that as the relative angle of the valve body 404 to the housing 400 changes, the opening degrees of the ports 401, 402, and 403 change as shown in FIG. 6.

That is, in the multi-way valve 4, when the valve body 404 is rotated in the plus direction from the position of relative angle "0 [°]", the heater port 402 starts to open first, and as the relative angle increases, the opening degree of the heater port 402 gradually increases. Then, after the heater port 402 is fully opened, when the relative angle is further increased, the device port 403 starts to open. As the relative angle increases, the opening degree of the device port 403 increases. After the device port 403 is fully opened, the radiator port 401 starts to open. As the relative angle increases, the opening degree of the radiator port 401 increases. Then, the radiator port 401 is fully opened before reaching a position of relative angle "+β[°]" where the engaging portion 406 and the stopper 413 abut against each other. Then, the state where the ports 401, 402, and 403 are fully opened is maintained until the position of relative angle "+β[°]" is reached. Therefore, in the multi-way valve 4, the end of the movable range in the plus direction of the valve body 404 and the motor 408 is the position of relative angle "+β[°]", and the opening degree of the valve body 404 at this position is a stopper opening degree in the plus direction. In short, the stopper opening degree in the plus direction is an opening degree in the state where all the ports 401, 402, and 403 are fully opened, and is the maximum value of opening degree of the valve body 404.

On the other hand, in the multi-way valve 4, when the valve body 404 is rotated in the minus direction from the position of relative angle "0 [°]", the heater port 402 does not open. In this case, the device port 403 starts to open first, and as the relative angle increases, the opening degree of the device port 403 gradually increases. Then, after the device port 403 is fully opened, when the relative angle is further increased, the radiator port 401 starts to open. Note that when rotating the valve body 404 in the minus direction, an increase in the absolute value of the relative angle is expressed as an increase in the relative angle. As the relative angle increases, the opening degree of the radiator port 401 increases. Then, the radiator port 401 is fully opened before reaching a position of relative angle "−[°]" where the engaging portion 406 and the stopper 413 abut against each other. Then, the state where the radiator port 401 and the device port 403 are fully opened is maintained until the position of relative angle "−α[°]" is reached. Therefore, in the multi-way valve 4, the end of the movable range in the minus direction of the valve body 404 and the motor 408 is the position of relative angle "−α[°]", and the opening degree of the valve body 404 at this position is a stopper opening degree in the minus direction. In short, the stopper opening degree in the minus direction is an opening degree in the state where the radiator port 401 and the device port 403 are fully opened.

In this way, the multi-way valve 4 is configured such that the valve body 404 is moved in the plus direction as a first direction or the minus direction as a second direction opposite to the plus direction within the predetermined range until it abuts against the stopper 413 in the housing 400. It is configured that even when the valve body 404 is rotated in either direction, the opening degree of the valve body 404 increases as the relative angle increases.

Figure 7:
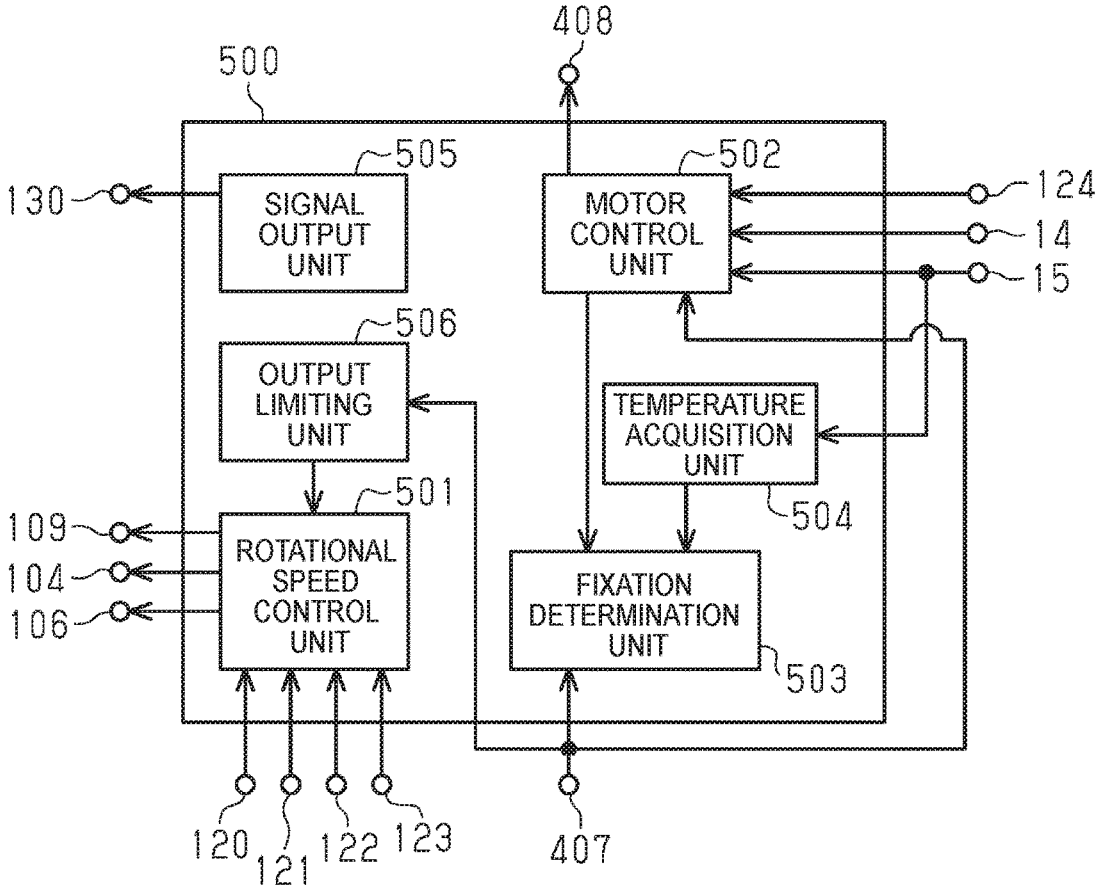
FIG. 7 is a block diagram showing the relationship of respective functional units of the ECU.

Next, an ECU 500 that controls the internal combustion engine 1 equipped with the above-described cooling system will be described with reference to FIG. 7. The ECU 500 is constituted as a computer unit including a central processing unit that performs various calculations for controlling the internal combustion engine 1 and the cooling system, a memory storing control programs and data, and so on. FIG. 7 is a block diagram showing the relationship of respective functional units of the ECU 500.

The ECU 500 includes a rotational speed control unit 501 that controls the engine rotational speed which is the rotational speed of the crankshaft of the internal combustion engine 1. A vehicle speed sensor 120 that detects a vehicle speed, an accelerator position sensor 121 that detects an opening degree of an accelerator, an air flow meter 122 that detects an amount of air flowing in an intake passage of the internal combustion engine 1, a crank position sensor 123 that detects an engine rotational speed, and so on are connected to the rotational speed control unit 501. Normally, in order to obtain the required torque, the rotational speed control unit 501 controls the engine rotational speed by controlling injectors 106, spark plugs 104, and a throttle valve motor 109 of the internal combustion engine 1 based on signals input from the sensors 120 to 123 and so on.

Further, the ECU 500 includes a motor control unit 502 that controls the relative angle of the valve body 404 to the housing 400 by controlling energization to the motor 408 of the multi-way valve 4. The head liquid temperature sensor 14, the outlet liquid temperature sensor 15, the position sensor 407, and an outside air temperature sensor 124 are connected to the motor control unit 502. The motor control unit 502 acquires a relative angle as a position of the valve body 404 according to the magnitude of a voltage (signal) output from the position sensor 407. Normally, while acquiring the relative angle of the valve body 404 in this way, the motor control unit 502 feedback-controls, by PI control, energization to the motor 408 so that the relative angle of the valve body 404 approaches a target value. Hereinafter, such normal PI control that is performed by the motor control unit 502 will be referred to as "normal control".

In this way, the ECU 500 controls the relative angle of the valve body 404 in the multi-way valve 4, thereby switching the circulation path of the cooling liquid in the cooling system for the internal combustion engine 1 through the normal control and controlling the amount of the cooling liquid to be circulated. The motor control unit 502 controls energization to the motor 408 to control the driving of the motor 408 by pulse width modulation control. That is, the motor control unit 502 controls the torque of the motor 408 by changing the duty cycle between "0 [%]" where the motor 408 is not energized and thus is not driven, and "100 [%]" where the torque of the motor 408 becomes maximum.

In the normal control, the motor control unit 502 performs switching between a summer mode and a winter mode according to an outside air temperature detected by the outside air temperature sensor 124. The motor control unit 502 controls the motor 408 in the winter mode when the outside air temperature is equal to or less than a reference temperature so that there is a possibility that the heater of the air conditioner may be used. In the winter mode, the motor 408 is controlled in a range where the relative angle becomes plus. On the other hand, the motor control unit 502 controls the motor 408 in the summer mode when the outside air temperature is higher than the reference temperature. In the summer mode, the motor 408 is controlled in a range where the relative angle becomes minus.

Further, the ECU 500 includes a temperature acquisition unit 504 that acquires a temperature of the cooling liquid flowing in the circulation path. The outlet liquid temperature sensor 15 is connected to the temperature acquisition unit 504, so that the temperature acquisition unit 504 acquires from the outlet liquid temperature sensor 15 a temperature of the cooling liquid that has passed through the water jacket 2A and is discharged into the multi-way valve 4.

Further, the ECU 500 includes a fixation determination unit 503 that makes a determination on fixation of the valve body 404. The position sensor 407, the motor control unit 502, and the temperature acquisition unit 504 are connected to the fixation determination unit 503. The fixation determination unit 503 receives a signal indicative of a driving state of the motor 408 from the motor control unit 502, thereby acquiring the driving state of the motor 408.

The vehicle is provided with a warning lamp 130 that serves as a notification device for notifying an abnormality of the multi-way valve 4 to a driver of the vehicle. The ECU 500 includes a signal output unit 505 that outputs a signal to turn on the warning lamp 130. That is, the signal output unit 505 outputs a signal that causes the warning lamp 130 as the notification device to carry out notification. Further, the ECU 500 includes an output limiting unit 506 that issues a command to the rotational speed control unit 501 to perform an output limitation process to limit the output of the internal combustion engine 1. The position sensor 407 is connected to the output limiting unit 506.

Hereinbelow, a description will be given of processing that is executed by the ECU 500 for determining whether or not the valve body 404 is fixed, and for diagnosis of abnormality. Herein, fixation of the valve body 404 means that the relative angle of the valve body 404 cannot be controlled in the multi-way valve 4 due to foreign matter jammed between the housing 400 and the valve body 404 or jammed in the gears 409 between the valve body 404 and the motor 408, or the like.

Figure 8:
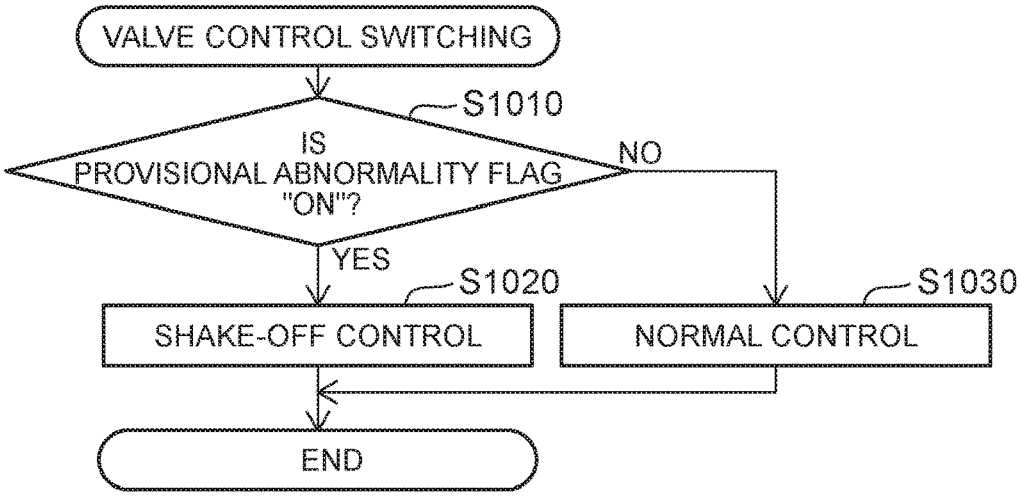
FIG. 8 is a flowchart showing the flow of a valve control switching process executed by the ECU.

In the ECU 500, the control manner of the multi-way valve 4 is switched according to a state of a provisional abnormality flag through a valve control switching process shown in FIG. 8. The valve control switching process is repeatedly performed by the motor control unit 502 at a predetermined control period when the ECU 500 is energized and valve control of the multi-way valve 4 is not prohibited. The provisional abnormality flag is a flag that is set to "ON" when the valve body 404 is determined to be fixed through a provisional abnormality determination process which will be described later with reference to FIG. 9. The provisional abnormality flag is stored in the memory of the ECU 500 and is "OFF" in an initial state.

As shown in FIG. 8, when this process has started, the motor control unit 502, at step S1010, reads the provisional abnormality flag and determines whether or not the provisional abnormality flag is "ON". When the motor control unit 502 has determined at step S1010 that the provisional abnormality flag is "OFF" (step S1010: NO), the motor control unit 502 causes the process to proceed to step S1030. At step S1030, the motor control unit 502 selects normal control as the control manner of the multi-way valve 4. When the motor control unit 502 has selected the normal control in this way, the motor control unit 502 controls energization to the motor 408 by PI control as described above.

On the other hand, when the motor control unit 502 has determined at step S1010 that the provisional abnormality flag is "ON" (step S1010: YES), the motor control unit 502 causes the process to proceed to step S1020. At step S1020, the motor control unit 502 selects shake-off control as the control manner of the multi-way valve 4. When the motor control unit 502 has selected the shake-off control in this way, the motor control unit 502 controls energization to the motor 408 through the shake-off control which will be described later with reference to FIGS. 11 to 13. The shake-off control is fixation-time control that is performed when the provisional abnormality flag is determined to be "ON", i.e. when the valve body 404 is determined to be fixed, and is control for forcing foreign matter jammed in the gears 409 or the like to come off a jammed portion.

When the motor control unit 502 has selected the shake-off control at step S1020 or the normal control at step S1030, the motor control unit 502 once ends the valve control switching process.

Figure 9:
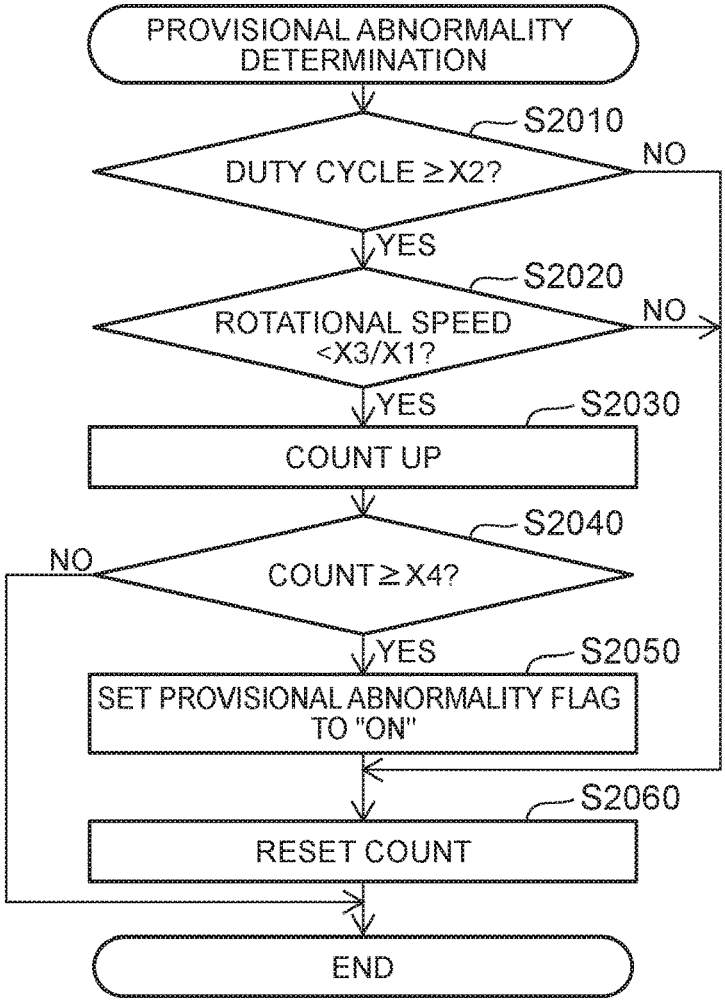
FIG. 9 is a flowchart showing the flow of a provisional abnormality determination process executed by the ECU.
Figure 10:
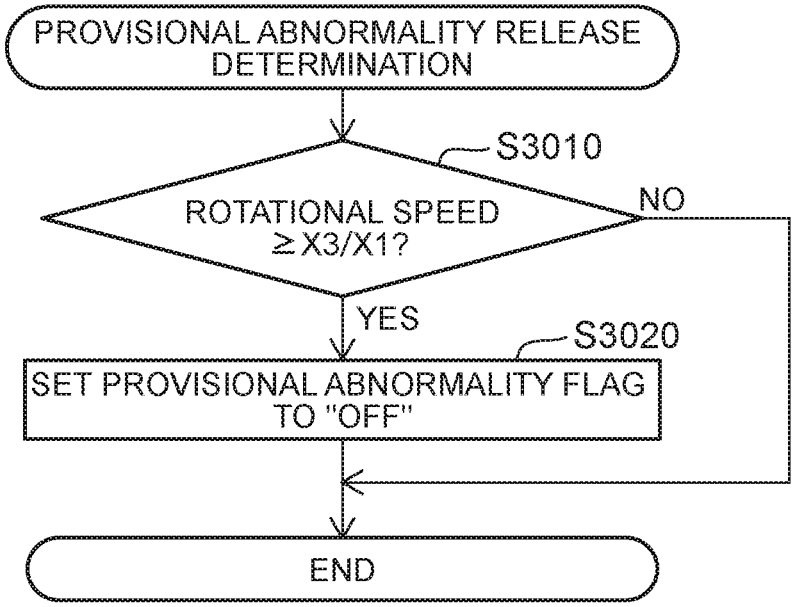
FIG. 10 is a flowchart showing the flow of a provisional abnormality release determination process executed by the ECU.

Next, the provisional abnormality determination process will be described with reference to FIG. 9. The provisional abnormality determination process shown in FIG. 9 is repeatedly performed by the fixation determination unit 503 at a predetermined control period when the provisional abnormality flag is "OFF", i.e. when the normal control is being performed by the motor control unit 502. The control period herein is set to "X1 [msec]". That is, the provisional abnormality determination process is repeatedly performed every "X1 [msec]" in parallel to the normal control performed by the motor control unit 502.

When this process has started, the fixation determination unit 503 determines at step S2010 whether or not the duty cycle controlled by the motor control unit 502 is equal to or more than "X2 [%]". When the fixation determination unit 503 has determined at step S2010 that the duty cycle is equal to or more than "X2 [%]" (step S2010: YES), the fixation determination unit 503 causes the process to proceed to step S2020.

At step S2020, the fixation determination unit 503 determines whether or not the rotational speed of the valve body 404 is less than "X3/X1 [°/msec]". Specifically, the fixation determination unit 503 acquires a voltage that is output from the position sensor 407, thereby acquiring a position of the valve body 404 according to the magnitude of the acquired voltage. Then, the fixation determination unit 503 acquires whether or not the amount of change from a position of the valve body 404 acquired in the last control period is less than "X3 [°]". In this way, the fixation determination unit 503 determines whether or not the rotational speed of the valve body 404 is less than "X3/X1 [°/msec]". That is, at step S2020, the fixation determination unit 503 determines whether or not the amount of movement of the valve body 404 for the predetermined time period, "X1 [msec]", is less than the reference value, "X3 [°]".

The magnitude of the value, "X2 [%]", used as the threshold value for determination at step S2010 is set in a range where the rotational speed of the valve body 404 becomes equal to or more than "X3/X1 [°/msec]" when the valve body 404 is driven through the normal control unless the valve body 404 is fixed. It is possible to achieve setting of such a magnitude of value by carrying out experiments or the like in advance.

When the fixation determination unit 503 has determined at step S2020 that the rotational speed of the valve body 404 is less than "X3/X1 [°/msec]" (step S2020: YES), the fixation determination unit 503 causes the process to proceed to step S2030. At step S2030, the fixation determination unit 503 counts up the value of a counter by 1. Then, the fixation determination unit 503 causes the process to proceed to step S2040.

At step S2040, the fixation determination unit 503 determines whether or not the count of the counter is equal to or more than "X4". When the fixation determination unit 503 has determined at step S2040 that the count of the counter is equal to or more than "X4" (step S2040: YES), the fixation determination unit 503 causes the process to proceed to step S2050 and sets the provisional abnormality flag to "ON". Then, the fixation determination unit 503 resets the count of the counter at step S2060 and once ends this process.

On the other hand, when the fixation determination unit 503 has determined at step S2040 that the count of the counter is less than "X4" (step S2040: NO), the fixation determination unit 503 once ends this process without performing steps S2050 and S2060.

When the fixation determination unit 503 has made a negative determination at step S2010 or S2020 (step S2010: NO, step S2020: NO), the fixation determination unit 503 causes the process to proceed to step S2060.

That is, in the provisional abnormality determination process, the value of the counter is counted up by 1 when the condition is established that the rotational speed is less than "X3/X1 [°/msec]" although the duty cycle is equal to or more than "X2 [%]", while, when this condition is not established, the count is reset. In this way, the time period during which the state where this condition is established is continued is measured by the magnitude of the value of the counter.

The fixation determination unit 503 repeatedly performs the provisional abnormality determination process every "X1 [msec]", and when the count in the state where this condition is established is continued for a certain time period until reaching "X4", the fixation determination unit 503 determines that the valve body 404 is fixed, and sets the provisional abnormality flag to "ON".

The magnitude of the value, "X4", used as the threshold value for determination at step S2040 is set to a value equal to or more than "2". Accordingly, the above-described certain time period, that is required until the provisional abnormality flag is set to "ON" when the condition continues to be established that the rotational speed is less than "X3/X1 [°/msec]" although the duty cycle is equal to or more than "X2 [%]", is longer than "X1 [msec]".

As described above with reference to FIG. 8, when the provisional abnormality flag is "ON", the shake-off control is selected as the control manner of the multi-way valve 4 and performed. When the shake-off control is being performed, there is a possibility that the fixation of the valve body 404 may be eliminated, and therefore, when the shake-off control is being performed, the fixation determination unit 503 performs a provisional abnormality release determination process shown in FIG. 10. Then, when the fixation of the valve body 404 is eliminated, the fixation determination unit 503 sets the provisional abnormality flag to "OFF" through the provisional abnormality release determination process.

Specifically, the provisional abnormality release determination process is repeatedly performed by the fixation determination unit 503 at a predetermined control period when the provisional abnormality flag is "ON", i.e. when the shake-off control is being performed by the motor control unit 502. The control period herein is set to "X1 [msec]" like the provisional abnormality determination process. That is, the provisional abnormality release determination process is repeatedly performed every "X1 [msec]" in parallel to the shake-off control performed by the motor control unit 502.

When this process has started, the fixation determination unit 503 determines at step S3010 whether or not the rotational speed of the valve body 404 is equal to or more than "X3/X1 [°/msec]". A method for confirming the rotational speed of the valve body 404 at step S3010 is the same as that at step S2020 in the provisional abnormality determination process. That is, at step S3010, based on the amount of change of a position of the valve body 404 from that in the last control period, the fixation determination unit 503 determines whether or not the amount of movement of the valve body 404 for the predetermined time period, "X1 [msec]", is equal to or more than the reference value, "X3 [°]".

When the fixation determination unit 503 has determined at step S3010 that the rotational speed of the valve body 404 is equal to or more than "X3/X1 [°/msec]" (step S3010: YES), the fixation determination unit 503 causes the process to proceed to step S3020. Then, the fixation determination unit 503 sets the provisional abnormality flag to "OFF" at step S3020 and once ends this process.

On the other hand, when the fixation determination unit 503 has determined at step S3010 that the rotational speed of the valve body 404 is less than "X3/X1 [°/msec]" (step S3010: NO), the fixation determination unit 503 once ends this process without performing step S3020.

That is, in the provisional abnormality release determination process, when the condition that the rotational speed is equal to or more than "X3/X1 [°/msec]" is established, the provisional abnormality flag is set to "OFF".

The fixation determination unit 503 repeatedly performs the provisional abnormality release determination process every "X1 [msec]" when the shake-off control is being performed, and when the rotational speed has become equal to or more than "X3/X1 [°/msec]", the fixation determination unit 503 determines that the fixation of the valve body 404 is eliminated, and sets the provisional abnormality flag to "OFF".

Next, the shake-off control as the fixation-time control will be described in detail with reference to FIGS. 11 to 13. When the shake-off control is selected through the valve control switching process described with reference to FIG. 8, the motor control unit 502 first performs a shake-off control mode setting process shown in FIG. 11. This process is performed when the control manner of the multi-way valve 4 selected through the valve control switching process has changed from the normal control to the shake-off control.

Figure 11:
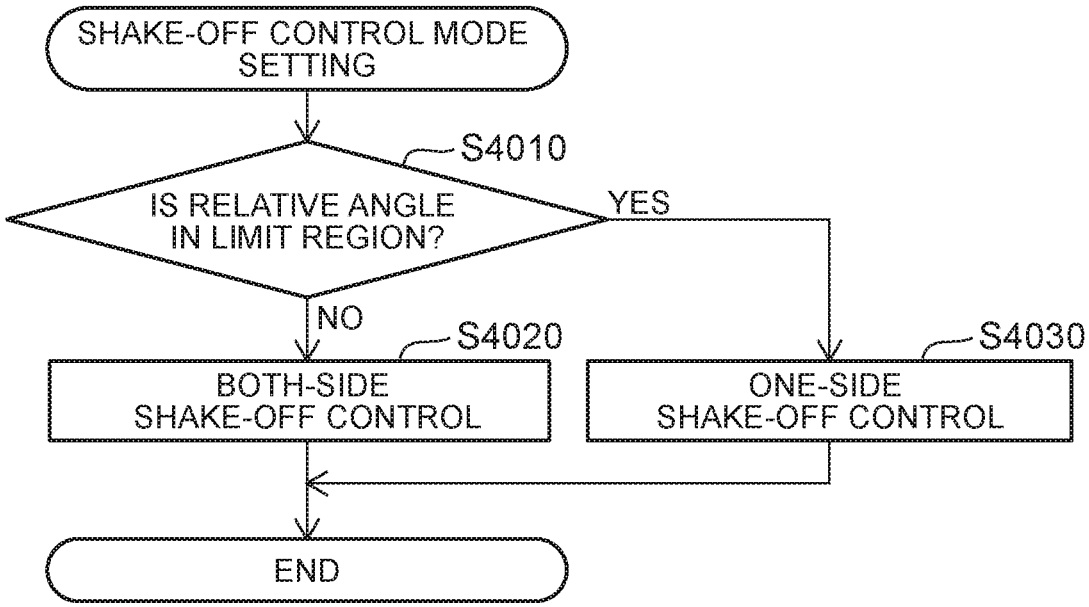
FIG. 11 is a flowchart showing the flow of a shake-off control mode setting process executed by the ECU.

As shown in FIG. 11, when this process has started, the motor control unit 502, at step S4010, acquires a voltage that is output from the position sensor 407, and determines according to the magnitude of the acquired voltage whether or not the relative angle of the valve body 404 is in a limit region. The limit region is a region just before reaching the stopper opening degree in the plus direction or a region just before reaching the stopper opening degree in the minus direction and is provided for preventing the engaging portion 406 of the valve body 404 from colliding with the stopper 413 when the fixation of the valve body 404 is eliminated. For example, regions each in a range of "several to ten and several [°]" before "−α[°]" or "+β[°]" as the stopper opening degree are set as the limit regions. That is, the motor control unit 502 determines at step S4010 whether or not the distance from the engaging portion 406 of the valve body 404 to the stopper 413, i.e. the rotatable distance of the valve body 404, is less than a predetermined distance.

When the motor control unit 502 has determined at step S4010 that the relative angle of the valve body 404 is not in the limit region (step S4010: NO), the motor control unit 502 causes the process to proceed to step S4020 where the motor control unit 502 selects and sets both-side shake-off control as a mode of the shake-off control. On the other hand, when the motor control unit 502 has determined at step S4010 that the relative angle of the valve body 404 is in the limit region (step S4010: YES), the motor control unit 502 causes the process to proceed to step S4030 where the motor control unit 502 selects and sets one-side shake-off control as a mode of the shake-off control. When the motor control unit 502 has set the mode of the shake-off control in this way, the motor control unit 502 ends this process.

After the shake-off control mode setting is performed in this way when the selected control manner of the multi-way valve 4 has changed from the normal control to the shake-off control, as long as the shake-off control continues to be selected in the valve control switching process, the shake-off control of the mode set herein continues to be performed. That is, when the both-side shake-off control is selected and set as the mode of the shake-off control through the mode setting process, as long as the shake-off control continues to be selected in the valve control switching process, the both-side shake-off control continues to be performed as the shake-off control.

Next, the flow of a both-side shake-off control process will be described in detail with reference to FIG. 12. This series of processing is repeatedly performed by the motor control unit 502 when the both-side shake-off control is set as the mode of the shake-off control and the shake-off control is selected in the valve control switching process.

Figure 12:
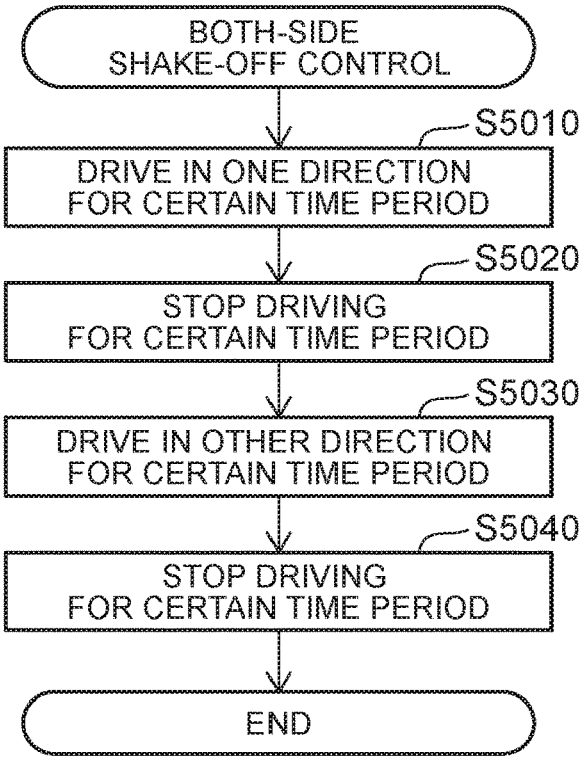
FIG. 12 is a flowchart showing the flow of a both-side shake-off control process executed by the ECU.

As shown in FIG. 12, when this process has started, the motor control unit 502, at step S5010, drives the valve body 404 in one of the plus direction and the minus direction for a certain time period. At step S5010 in the both-side shake-off control, the valve body 404 is driven in a direction opposite to a direction in which the valve body 404 was driven when the fixation was determined to be occurring. Therefore, in the case where the driving direction of the valve body 404 is the plus direction when the provisional abnormality flag has changed from "OFF" to "ON", the valve body 404 is driven in the minus direction at step S5010. On the other hand, in the case where the driving direction of the valve body 404 is the minus direction when the provisional abnormality flag has changed from "OFF" to "ON", the valve body 404 is driven in the plus direction at step S5010.

At step S5010, feedback control is not performed, and the motor 408 is driven by setting the duty cycle to "100 [%]". Incidentally, in the normal control, the duty cycle is feedback-controlled by PI control and is not set to "100 [%]". Therefore, in this process, the motor 408 is controlled to produce a torque greater than a torque of the motor 408 that is produced when it is not determined that the valve body 404 is fixed so that the normal control is performed. At step S5010, the valve body 404 continues to be driven for the certain time period, such as, for example, for a time period of "several hundred [msec]" to "several thousand [msec]". Then, when the driving for the certain time period at step S5010 has ended, the motor control unit 502 causes the process to proceed to step S5020.

At step S5020, the driving of the valve body 404 is stopped for a certain time period. That is, the duty cycle is set to "0 [%]" to stop energization to the motor 408, thereby stopping the driving of the valve body 404. Herein, for example, the driving of the valve body 404 is stopped for a time period of "several hundred [msec]" which is shorter than the driving time period at step S5010. After setting the driving stop time period at step S5020, the motor control unit 502 causes the process to proceed to step S5030.

At step S5030, the motor control unit 502 drives the valve body 404 in the other of the plus direction and the minus direction for a certain time period. That is, the valve body 404 is driven in the direction opposite to the driving direction at step S5010.

At step S5030, like at step S5010, feedback control is not performed, and the motor 408 is driven by setting the duty cycle to "100 [%]" for the same time period as the driving time period at step S5010. Then, when the driving for the certain time period at step S5030 has ended, the motor control unit 502 causes the process to proceed to step S5040. At step S5040, like at step S5020, the motor control unit 502 stops the driving of the valve body 404 for a certain time period.

When the motor control unit 502 has stopped the driving of the valve body 404 for the certain time period at step S5040 in this way, the motor control unit 502 once ends this process. As described above, the both-side shake-off control process is repeatedly performed when the shake-off control is being selected in the valve control switching process. Therefore, in the case where the shake-off control is being selected in the valve control switching process when step S5040 has ended, the process is repeated again from step S5010. When the control manner of the valve body 404 is switched to the normal control in the valve control switching process or the valve control of the multi-way valve 4 is prohibited while the both-side shake-off control process is being performed, the motor control unit 502 stops and ends this process.

Next, the flow of a one-side shake-off control process will be described in detail with reference to FIG. 13. This series of processing is repeatedly performed by the motor control unit 502 when the one-side shake-off control is set as the mode of the shake-off control and the shake-off control is selected in the valve control switching process.

Figure 13:
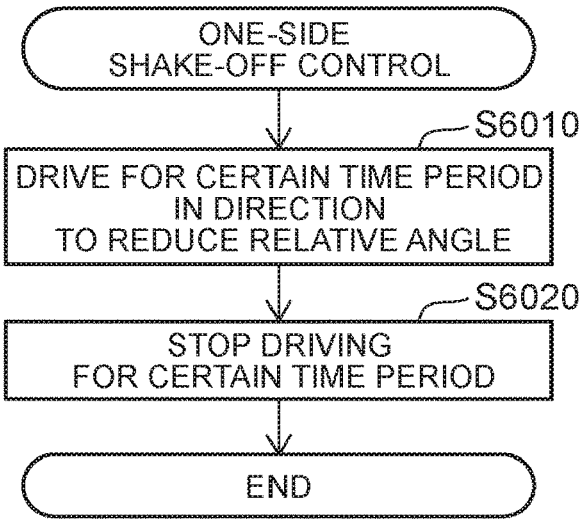
FIG. 13 is a flowchart showing the flow of a one-side shake-off control process executed by the ECU.

As shown in FIG. 13, when this process has started, the motor control unit 502, at step S6010, drives the valve body 404 for a certain time period in a direction to reduce the relative angle (a direction to cause the relative angle to approach "0 [°]"). When the one-side shake-off control is set as the mode of the shake-off control, the relative angle of the valve body 404 is in the limit region on either the plus side or the minus side. That is, the relative angle is extremely large. Therefore, at step S6010, when the relative angle of the valve body 404 is in the limit region on the minus side, the valve body 404 is driven in the plus direction, while, when the relative angle of the valve body 404 is in the limit region on the plus side, the valve body 404 is driven in the minus direction. At step S6010, like at step S5010 in the both-side shake-off control, feedback control is not performed, and the motor 408 is driven by setting the duty cycle to "100 [%]" for the same time period as the driving time period at step S5010. Then, when the driving for the certain time period at step S6010 has ended, the motor control unit 502 causes the process to proceed to step S6020. At step S6020, like at step S5020 in the both-side shake-off control, the motor control unit 502 stops the driving of the valve body 404 for a certain time period.

When the motor control unit 502 has stopped the driving of the valve body 404 for the certain time period at step S6020 in this way, the motor control unit 502 once ends this process. Like the both-side shake-off control process, the one-side shake-off control process is repeatedly performed when the shake-off control is being selected in the valve control switching process. Therefore, in the case where the shake-off control is being selected in the valve control switching process when step S6020 has ended, the process is repeated again from step S6010. When the control manner of the valve body 404 is switched to the normal control in the valve control switching process or the valve control of the multi-way valve 4 is prohibited while the one-side shake-off control process is being performed, the motor control unit 502 stops and ends this process.

As described above, when the relative angle of the valve body 404 is not in the limit region, the motor control unit 502 performs the both-side shake-off control and drives the valve body 404 in the plus direction and the minus direction alternately. On the other hand, when the relative angle of the valve body 404 is in the limit region, the motor control unit 502 performs the one-side shake-off control.

In the one-side shake-off control, when the relative angle of the valve body 404 is in the limit region on the minus side, the driving in the minus direction is not performed, and the driving in the plus direction is repeated. On the other hand, when the relative angle of the valve body 404 is in the limit region on the plus side, the driving in the plus direction is not performed, and the driving in the minus direction is repeated. In this way, in the one-side shake-off control, when the distance to the stopper 413 is less than the predetermined distance so that the relative angle of the valve body 404 is in the limit region in the plus direction or the minus direction, energization to the motor 408 is controlled to drive the valve body 404 in the other direction. Accordingly, it is prohibited to energize the motor 408 so as to drive the valve body 404 in the direction to cause the engaging portion 406 of the valve body 404 to further approach the stopper opening degree in the limit region. In this way, in order to prevent a collision between the engaging portion 406 of the valve body 404 and the stopper 413 when the fixation is eliminated through the shake-off control, a range where there is a possibility of collision with the stopper 413 when the fixation is eliminated is calculated in advance through experiments or the like and set as the limit region in the ECU 500.

Figure 14:
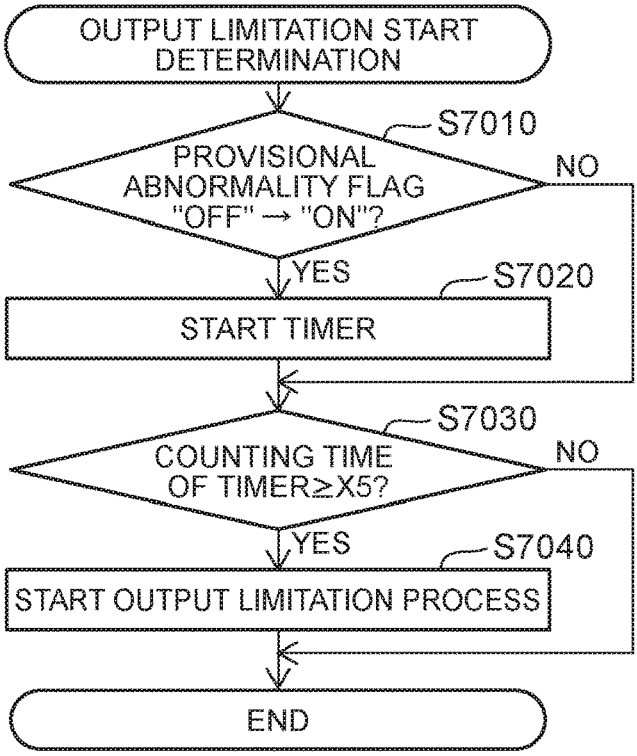
FIG. 14 is a flowchart showing the flow of an output limitation start determination process executed by the ECU.

Further, in the ECU 500, an output limitation process to limit the output of the internal combustion engine 1 is performed when the shake-off control is being performed. FIG. 14 is a flowchart showing an output limitation start determination process that starts the output limitation process. This determination process is repeatedly performed by the output limiting unit 506 of the ECU 500 when the ECU 500 is energized.

As shown in FIG. 14, when this process has started, the output limiting unit 506, at step S7010, reads the provisional abnormality flag and determines whether or not it is a timing at which the provisional abnormality flag has changed from "OFF" to "ON". Specifically, the output limiting unit 506 makes a comparison between the provisional abnormality flag read in the last control period and the provisional abnormality flag read in the current control period. Then, when the provisional abnormality flag read in the last control period is "OFF" and the provisional abnormality flag read in the current control period is "ON", the output limiting unit 506 determines that it is the timing at which the provisional abnormality flag has changed from "OFF" to "ON".

When the output limiting unit 506 has determined at step S7010 that it is the timing at which the provisional abnormality flag has changed from "OFF" to "ON" (step S7010: YES), the output limiting unit 506 starts counting by a timer at step S7020. Then, the output limiting unit 506 causes the process to proceed to step S7030.

On the other hand, when the output limiting unit 506 has determined at step S7010 that it is not the timing at which the provisional abnormality flag has changed from "OFF" to "ON" (step S7010: NO), the output limiting unit 506 causes the process to proceed to step S7030 without performing step S7020. That is, when counting by the timer has already started, the counting is continued, and when counting by the timer has not yet started, the process proceeds to step S7030 while the timer is kept not to perform counting.

At step S7030, the output limiting unit 506 determines whether or not the counting time of the timer is equal to or more than "X5 [msec]". "X5 [msec]" is set to a length of a degree that can ensure a time during which the valve body 404 is driven at least one or more times in the shake-off control.

When the output limiting unit 506 has determined at step S7030 that the counting time of the timer is equal to or more than "X5 [msec]" (step S7030: YES), the output limiting unit 506 causes the process to proceed to step S7040 and starts an output limitation process. On the other hand, when the output limiting unit 506 has determined at step S7030 that the counting time of the timer is less than "X5 [msec]" (step S7030: NO), the output limiting unit 506 once ends this series of processing without performing step S7040. That is, the output limiting unit 506 performs the output limitation process after the lapse of "X5 [msec]" from the start of the shake-off control due to the change of the provisional abnormality flag from "OFF" to "ON".

Specifically, at step S7040, the output limiting unit 506 calculates an upper limit rotational speed of the engine rotational speed according to a acquired relative angle of the valve body 404 and commands the rotational speed control unit 501 not to exceed the calculated upper limit rotational speed. Accordingly, the output limitation process is achieved through the control of the engine rotational speed by the rotational speed control unit 501.

The reason for setting the upper limit rotational speed in this way is to prevent that when the engine rotational speed becomes high in the state where the valve body 404 is fixed with the relative angle being small so that the cooling liquid does not easily pass through the multi-way valve 4, the pressure in the circulation path becomes too high so that, for example, hoses or the like forming the circulation path come off.

Herein, the output limiting unit 506 refers to a map storing the relationship between a relative angle that is detected by the position sensor 407, and an upper limit rotational speed corresponding to the relative angle, and sets an upper limit rotational speed corresponding to a relative angle detected by the position sensor 407.

Figure 15:
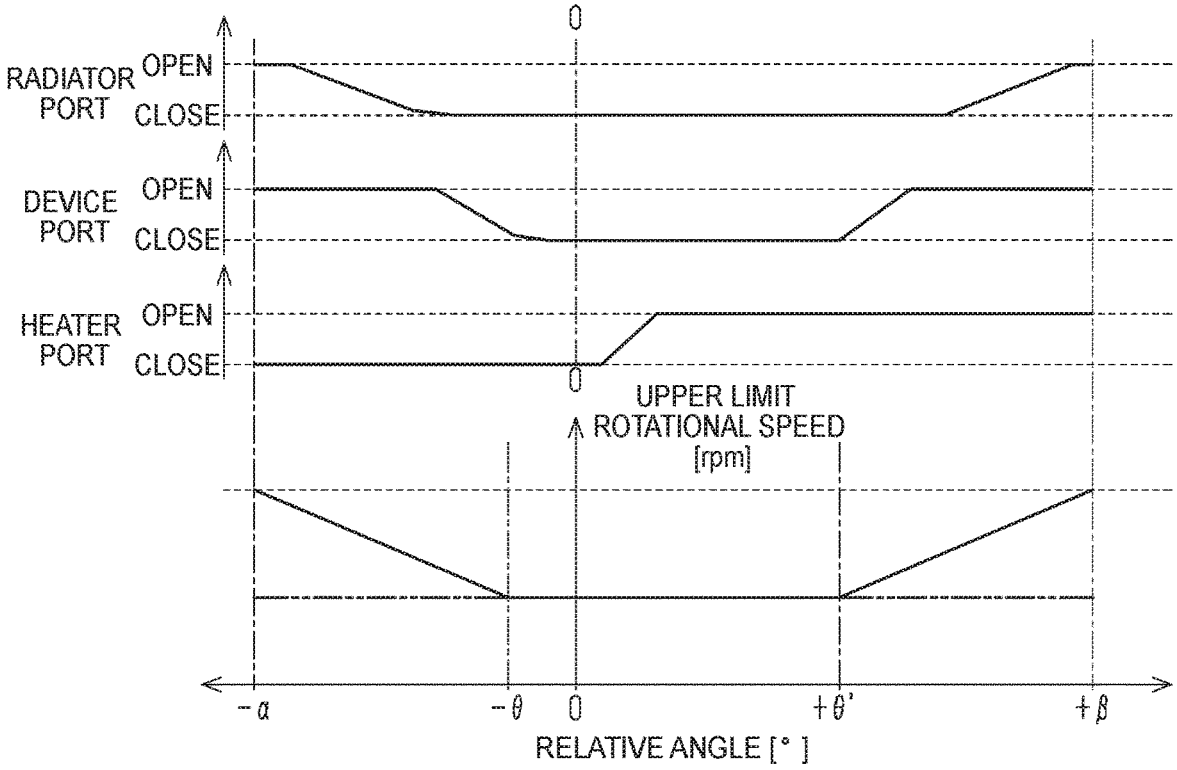
FIG. 15 is a graph showing the relationship between a relative angle of the valve body to the housing and an upper limit rotational speed in an output limitation process.

FIG. 15 shows the relationship between a relative angle that is detected by the position sensor 407, and an upper limit rotational speed. As shown by a solid line, it is seen that, in ranges ($-\theta$ to $-\alpha$, $+\theta$ to $+\beta$) each equal to or more than a relative angle at which the device port 403 starts to open, as the relative angle increases, the upper limit rotational speed gradually increases. As the relative angle of the valve body 404 increases so that the opening degrees of the device port 403 and the radiator port 401 increase, the cooling liquid passes through the multi-way valve 4 more easily, and therefore, even when the engine rotational speed becomes high so that the amount of the cooling liquid discharged from the cooling liquid pump 13 becomes large, the pressure in the circulation path hardly exceeds a predetermined value. Therefore, the map that is referred to by the output limiting unit 506 is produced by specifying, through experiments, an engine rotational speed range where the pressure in the circulation path becomes equal to or less than the predetermined value according to a relative angle of the valve body 404, and by setting values, that fall within that range, as upper limit rotational speeds.

Further, in FIG. 15, an upper limit rotational speed that is uniquely set assuming a state where the relative angle of the valve body 404 is "0 [°]" is shown by a two-dot chain line as a comparative example. It is seen that, in the case of the set values shown by the solid line, when the relative angle of the valve body 404 is large, the upper limit rotational speed becomes large compared to the set value shown by the two-dot chain line. Even by setting the upper limit rotational speed regardless of the magnitude of the relative angle as shown by the two-dot chain line, it is possible to prevent the pressure in the circulation path from becoming high. However, if the upper limit rotational speed is set so that the pressure in the circulation path becomes equal to or less than the predetermined value even when the relative angle of the valve body 404 is "0 [°]" as shown by the two-dot chain line, when the relative angle is an angle other than "0 [°]" so that any one of the ports 401, 402, and 403 is opened, the output of the internal combustion engine 1 is excessively limited. In this regard, if the upper limit rotational speeds corresponding to the relative angles are set as shown by the solid line, since it is possible to limit the output of the internal combustion engine 1 according to the relative angle of the valve body 404, it is possible, by performing the output limitation process, to prevent the pressure of the cooling liquid in the circulation path from becoming excessively high while preventing the output of the internal combustion engine 1 from being excessively limited.

Figure 16:
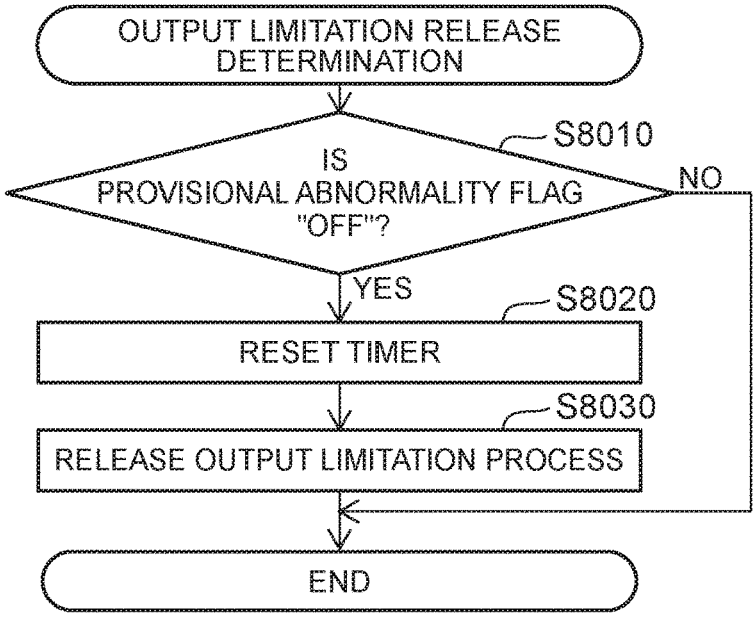
FIG. 16 is a flowchart showing the flow of an output limitation release determination process executed by the ECU.

Further, in the ECU 500, an output limitation release determination process is performed to determine whether or not to release the output limitation process. FIG. 16 shows the flow of this output limitation release determination process. The output limitation release determination process is repeatedly performed by the output limiting unit 506 when the ECU 500 is energized.

As shown in FIG. 16, when this process has started, the output limiting unit 506, at step S8010, reads the provisional abnormality flag and determines whether or not the provisional abnormality flag is "OFF".

When the output limiting unit 506 has determined at step S8010 that the provisional abnormality flag is "OFF" (step S8010: YES), the output limiting unit 506 causes the process to proceed to step S8020 and resets the counting by the timer. Then, at step S8030, the output limiting unit 506 releases the output limitation process.

Specifically, at step S8030, the output limiting unit 506 stops calculating an upper limit rotational speed of the engine rotational speed based on a relative angle of the valve body 404 and stops commanding the rotational speed control unit 501. Consequently, the rotational speed control unit 501 controls the engine rotational speed so as to obtain a required torque without limitation to the upper limit rotational speed.

When the output limiting unit 506 has released the output limitation process at step S8030, the output limiting unit 506 once ends this series of processing. In the case where the counting by the timer is not performed when the process has proceeded to step S8020 or in the case where the output limitation process is not performed when the process has proceeded to step S8030, the output limiting unit 506 once ends this series of processing.

On the other hand, when the output limiting unit 506 has determined at step S8010 that the provisional abnormality flag is "ON" (step S8010: NO), the output limiting unit 506 once ends this process without performing steps S8020 and S8030.

In the ECU 500, by repeating the above-described output limitation release determination process, the timer is reset and the output limitation process is released when the fixation of the valve body 404 is eliminated so that the provisional abnormality flag is set to "OFF".

As described above with reference to FIGS. 8 and 9, when a determination that the fixation is occurring is made by the fixation determination unit 503 so that the provisional abnormality flag is set to "ON", the shake-off control is started, and at this instant, counting by the timer is started as described above with reference to FIG. 14. Then, while the provisional abnormality flag continues to be "ON" so that the shake-off control is continued, the counting by the timer is continued. Therefore, in the ECU 500, using the counting time of the timer, when the shake-off control is continued for a certain time period, an abnormality diagnosis that an abnormality is occurring in the multi-way valve 4 is finalized.

Figure 17:
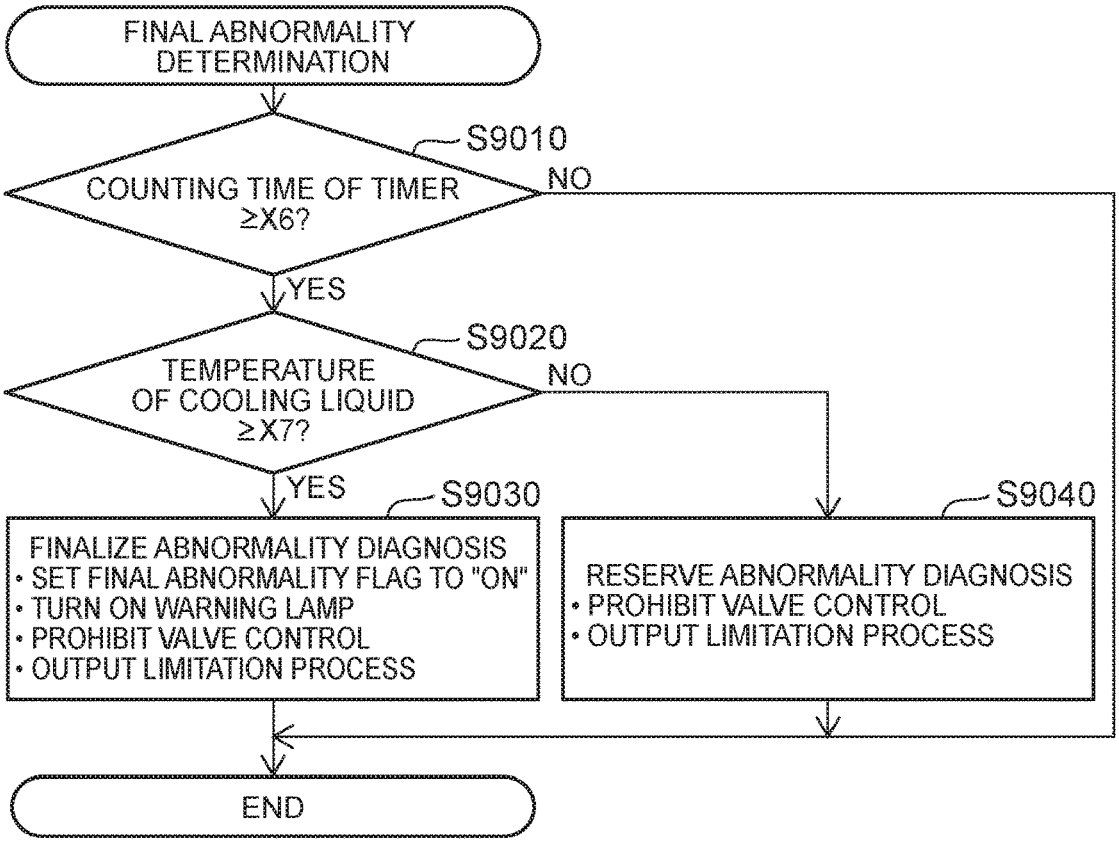
FIG. 17 is a flowchart showing the flow of a final abnormality determination process executed by the ECU.

FIG. 17 shows the flow of a final abnormality determination process as a process of finalizing the abnormality diagnosis. This final abnormality determination process is repeatedly performed by the fixation determination unit 503 when the ECU 500 is energized and the valve control is not prohibited.

As shown in FIG. 17, when this process has started, the fixation determination unit 503 determines at step S9010 whether or not the counting time of the timer is equal to or more than "X6 [msec]". "X6 [msec]" used as the threshold value for determination herein is set to a time that is longer than "X5 [msec]" used as the threshold value for determining whether or not to start the output limitation process, and that is longer than a time required for performing one time the both-side shake-off control described above with reference to FIG. 12.

When the fixation determination unit 503 has determined at step S9010 that the counting time of the timer is equal to or more than "X6 [msec]" (step S9010: YES), the fixation determination unit 503 determines at step S9020 whether or not the temperature of the cooling liquid acquired from the temperature acquisition unit 504 is equal to or more than "X7 [° C.]". "X7 [° C.]" used as the threshold value for determination herein is set to a value such that the cooling liquid in the circulation path can be determined to be frozen based on the fact that the temperature acquired from the temperature acquisition unit 504 is less than "X7 [° C.]".

When the fixation determination unit 503 has determined at step S9020 that the temperature of the cooling liquid is equal to or more than "X7 [° C.]" (step S9020: YES), the fixation determination unit 503 causes the process to proceed to step S9030 and finalizes an abnormality diagnosis. Specifically, the fixation determination unit 503 sets a final abnormality flag, indicative of the occurrence of an abnormality on the valve body 404, to "ON", thereby finalizing the abnormality diagnosis. After finalizing the abnormality diagnosis in this way, the fixation determination unit 503 ends this final abnormality determination process.

Note that when the abnormality diagnosis has been finalized so that the final abnormality flag is set to "ON", the ECU 500 turns on the warning lamp 130, prohibits the valve control of the valve body 404, and performs the output limitation process.

Accordingly, when the final abnormality flag is set to "ON" at step S9030, the signal output unit 505 outputs a signal to turn on the warning lamp 130 so that the warning lamp 130 is turned on. The occurrence of an abnormality is notified in this way, thereby prompting the maintenance. Following the prohibition of the valve control, the fixation determination unit 503 ends the shake-off control and stops the driving of the valve body 404. In order to continue the output limitation process, the output limiting unit 506 calculates an upper limit rotational speed of the engine rotational speed corresponding to a relative angle of the valve body 404 and continues to command the rotational speed control unit 501.

On the other hand, when the fixation determination unit 503 has determined at step S9010 that the counting time of the timer is equal to or more than "X6 [msec]", but has determined at step S9020 that the temperature of the cooling liquid is less than "X7 [° C.]" (step S9010: YES and step S9020: NO), the fixation determination unit 503 causes the process to proceed to step S9040 and reserves an abnormality diagnosis.

Specifically, when the fixation determination unit 503 has reserved the abnormality diagnosis at step S9040, the fixation determination unit 503 does not set the final abnormality flag to "ON" and does not turn on the warning lamp 130, but prohibits the valve control of the valve body 404 and performs the output limitation process. After reserving the abnormality diagnosis in this way, the fixation determination unit 503 ends this final abnormality determination process.

Following the finalization of the abnormality diagnosis or the reservation of the abnormality diagnosis, the fixation determination unit 503 resets the counting time of the timer and sets the provisional abnormality flag to "OFF" in the ECU 500. As described above, the valve control is prohibited at step S9030 and step S9040. Therefore, when step S9030 or step S9040 has been performed, the valve control is in a state of being prohibited, and accordingly, the final abnormality determination process is not performed thereafter.

On the other hand, when the fixation determination unit 503 has determined at step S9010 that the counting time of the timer is less than "X6 [msec]" (step S9010: NO), the fixation determination unit 503 once ends this final abnormality determination process without performing steps S9020 to S9040. That is, the valve control is not prohibited in this case. Therefore, the fixation determination unit 503 repeatedly performs the final abnormality determination process until the counting time of the timer becomes equal to or more than "X6 [msec]".

The final abnormality flag is stored in a backup memory of the ECU 500. Differently from the normal memory storing the provisional abnormality flag, the backup memory saves recordings even when the ECU 500 is not energized. Therefore, once the abnormality diagnosis has been finalized so that the final abnormality flag is set to "ON", even when energization to the ECU 500 is stopped, the state where the final abnormality flag is "ON" is maintained. Accordingly, once the abnormality diagnosis has been finalized, when, after the engine operation has finished so that energization to the ECU 500 is stopped, the engine operation is started again, the engine operation is carried out in the state where the final abnormality flag is "ON". As described above, when the final abnormality flag is "ON", the warning lamp 130 is turned on, the valve control is prohibited, and the output limitation process is performed. Therefore, once the abnormality diagnosis has been finalized, until the final abnormality flag stored in the backup memory is set to "OFF" by carrying out the maintenance or the like, the warning lamp 130 is turned on, the valve control is prohibited, and the output limitation process is performed.

On the other hand, in the case where the abnormality diagnosis is reserved, since the final abnormality flag is not set to "ON", when, after the engine operation has finished so that energization to the ECU 500 is stopped, the engine operation is started again, various controls described above with reference to FIGS. 8 to 17 are performed in a state where the prohibition of the valve control and the output limitation process are released.

Figure 18:
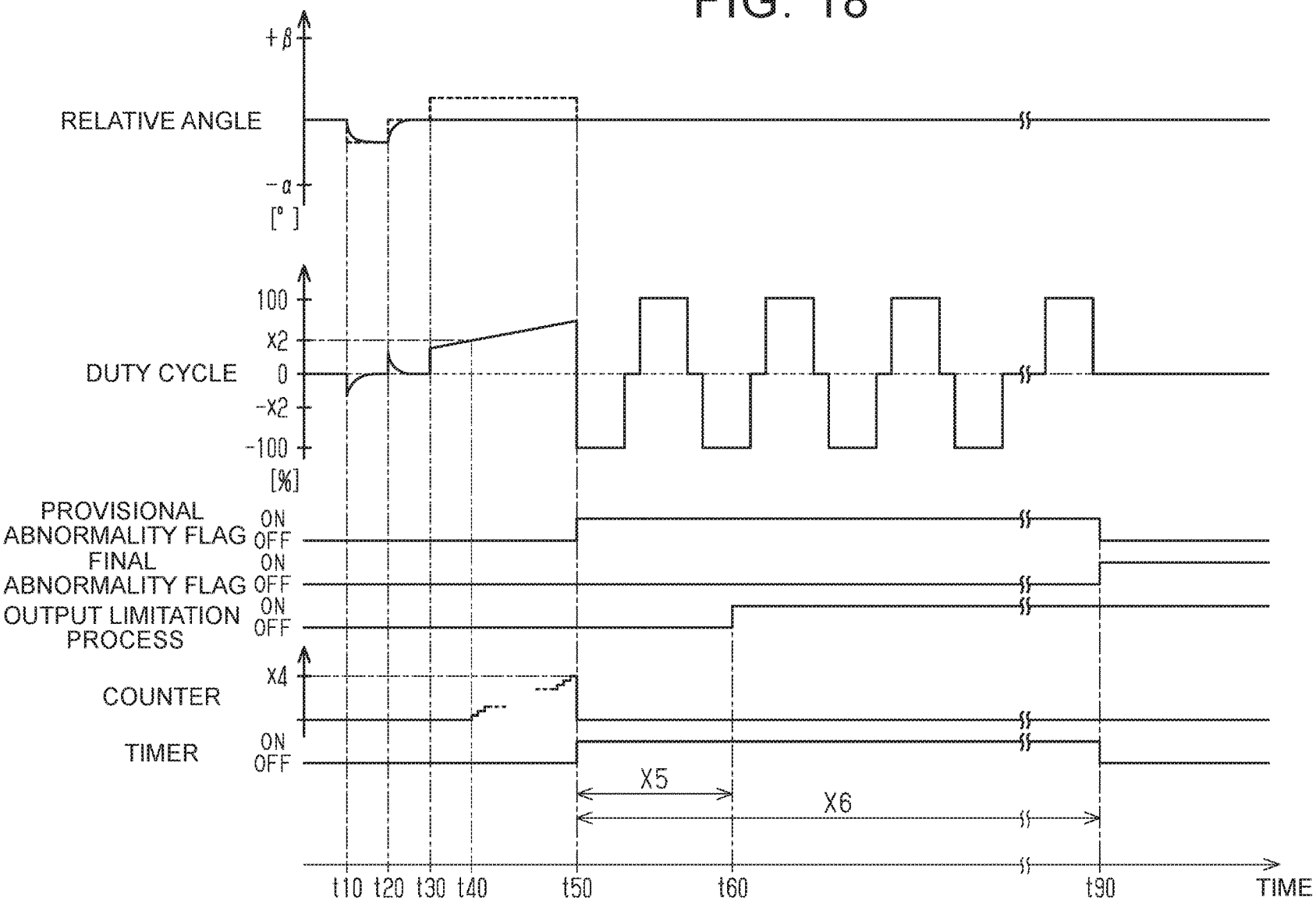
FIG. 18 is a time chart for explaining the transition of the state when an abnormality diagnosis is finalized through various processes executed by the ECU.
Figure 19:
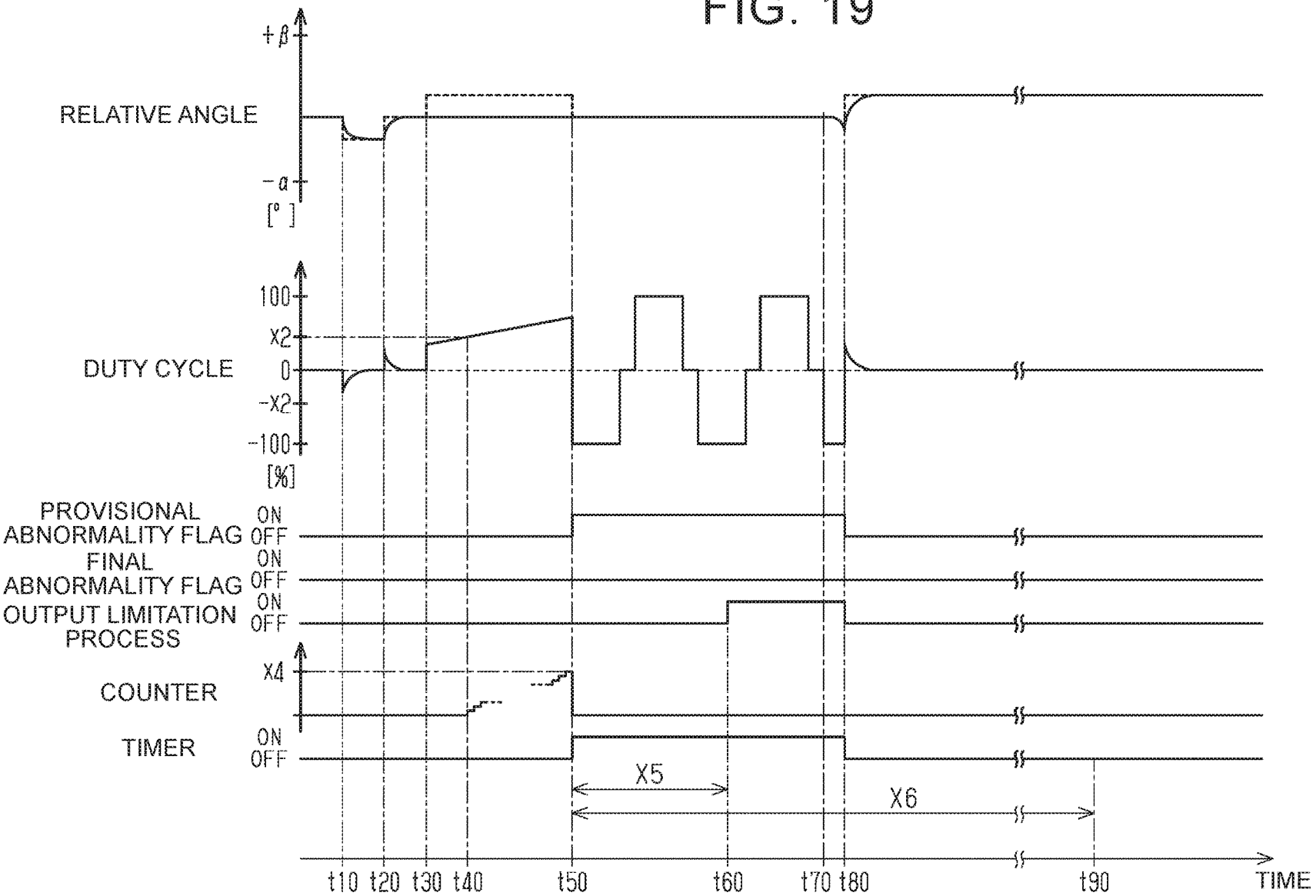
FIG. 19 is a time chart for explaining the transition of the state when fixation is eliminated before finalization of an abnormality diagnosis through various processes executed by the ECU.

In normal control of the multi-way valve 4 just after the start of the engine operation, the ECU 500 drives the valve body 404 in the minus direction and the plus direction for confirming the operation of the multi-way valve 4. FIGS. 18 and 19 each show the transition of the state when a determination of fixation is made in such normal control of the multi-way valve 4 just after the start of the engine operation.

FIG. 18 shows the transition of the state when fixation is not eliminated even by performing shake-off control so that the final abnormality flag is set to "ON" to finalize an abnormality diagnosis, while FIG. 19 shows the transition of the state when fixation is eliminated by performing shake-off control so that the final abnormality flag is not set to "ON". In FIGS. 18 and 19, for convenience of description, the duty cycle when driving the valve body 404 in the minus direction is given a minus sign to identify the direction in which the valve body 404 is driven. Therefore, herein, for example, "−X2 [%]" means that the motor 408 is driven in the minus direction at the duty cycle "X2 [%]". Therefore, "−100 [%]" means that the duty cycle at which the motor 408 is driven in the minus direction is greater than that in the case of "−X2 [%]" and thus that the torque of the motor 408 is greater than that in the case of "−X2 [%]".

First, referring to FIG. 18, the action by the ECU 500 will be described by exemplifying a case in which the final abnormality flag is set to "ON". As shown in FIG. 18, at time t10, in order to confirm the operation of the multi-way valve 4, the target relative angle is changed to a relative angle on the minus side as shown by a broken line. Consequently, the duty cycle is changed through PI control by the motor control unit 502 so that the valve body 404 is driven in the minus direction. In this event, since the cooling liquid is not frozen and fixation is not occurring, the relative angle of the valve body 404 changes to approach the target relative angle as shown by a solid line, and following it, the duty cycle decreases. By time t20, the relative angle becomes equal to the target relative angle and the duty cycle becomes "0 [%]".

Then, at time t20, the target relative angle is returned to a relative angle before the valve body 404 is driven at time t10 as shown by a broken line. Consequently, by time t30, the relative angle of the valve body 404 is returned to the relative angle before the valve body 404 is driven at time t10.

Then, at time t30, in order to confirm the operation of the multi-way valve 4, the target relative angle is changed to a relative angle on the plus side as shown by a broken line. Consequently, the duty cycle is changed through PI control so that the valve body 404 is driven in the plus direction. However, if fixation occurs in this event, since the relative angle does not change as shown by a solid line, the value of the integral term in the PI control increases so that the duty cycle gradually increases.

When the duty cycle increases in the state where the valve body 404 is not moved in this way, the duty cycle becomes equal to or more than "X2 [%]" at time t40. In this event, since the valve body 404 is not rotated, the rotational speed of the valve body 404 is less than "X3/X1 [°/msec]". Therefore, in this event, the value of the counter is counted up through the provisional abnormality determination process (FIG. 9).

Then, when the value of the counter becomes equal to or more than "X4" at time t50, it is determined by the fixation determination unit 503 that the valve body 404 is fixed, so that the provisional abnormality flag is set to "ON" from the initial state "OFF". When the provisional abnormality flag is set from "OFF" to "ON" in this way, counting by the timer is started (TIMER "ON" in FIG. 18) through the output limitation start determination process (FIG. 14), and shake-off control is selected through the valve control switching process (FIG. 8), so that the shake-off control is started from time t50.

In this event, since the relative angle is between "$-\alpha$[°]" and "$+\beta$[°]" and is not in the limit region, both-side shake-off control is set as the mode of the shake-off control through the shake-off control mode setting process (FIG. 11), so that the both-side shake-off control is performed. Since the valve body 404 was driven in the plus direction before the determination of the fixation, when starting the both-side shake-off control, the valve body 404 is first driven in the minus direction.

When the shake-off control has started in this way, the duty cycle is changed in the order of "−100 [%]", "0 [%]", "+100 [%]", "0 [%]" as shown by a solid line, so that the valve body 404 is driven in the minus direction and the plus direction alternately, while sandwiching a time period during which energization to the motor 408 is stopped to stop the driving of the valve body 404.

Then, when, at time t60, the counting time of the timer becomes equal to or more than "X5 [msec]" while the shake-off control is being performed, an output limitation process is started by the output limiting unit 506 through the output limitation start determination process (FIG. 14).

When the fixation is not eliminated even after the start of the output limitation process at time t60 so that the shake-off control is continued and the counting time of the timer becomes equal to or more than "X6 [msec]" at time t90, an abnormality diagnosis of the multi-way valve 4 is finalized by the fixation determination unit 503 through the final abnormality determination process (FIG. 17), so that the final abnormality flag is set from "OFF" to "ON".

By the finalization of the abnormality diagnosis in this way, the warning lamp 130 is turned on by the signal output unit 505, and the valve control by the motor control unit 502 is prohibited, while the output limitation process by the output limiting unit 506 is continued.

In this way, in the ECU 500, when the fixation determination unit 503 has determined that the valve body 404 is fixed so that the provisional abnormality flag is set to "ON", the motor control unit 502 performs the shake-off control to energize the motor 408 so as to drive the valve body 404. Then, the output limitation process is performed while the shake-off control is being performed, and when the fixation is not eliminated even by continuing the shake-off control for the certain time period, the abnormality diagnosis is finalized, so that the warning lamp 130 as the notification device is turned on to notify the occurrence of an abnormality.

Next, referring to FIG. 19, the action by the ECU 500 will be described by exemplifying a case in which the fixation is eliminated by the shake-off control so that the final abnormality flag is not set to "ON". Since the transition of the state from time t10 to time t60 is the same as that described above with reference to FIG. 18, the transition of the state and the action on and after time t70 will be described herein.

As shown in FIG. 19, at time t70 before time t90 at which the counting time of the timer becomes equal to or more than "X6 [msec]", the valve body 404 is driven in the minus direction by the shake-off control. When the fixation is eliminated by this driving of the valve body 404 in the minus direction, the relative angle of the valve body 404 changes to the minus side as shown by a solid line. When, based on this, a determination that the rotational speed of the valve body 404 is equal to or more than "X3/X1 [°/msec]" is made at time t80 before time t90 through the provisional abnormality release determination process (FIG. 10), it is determined by the fixation determination unit 503 that the fixation is eliminated, so that the provisional abnormality flag is set to "OFF".

Since the provisional abnormality flag is set to "OFF" in this way, the counting time of the timer is reset and the output limitation process is released through the output limitation release determination process (FIG. 16). Therefore, in this case, the counting time of the timer does not become equal to or more than "X6 [msec]", so that finalization of an abnormality diagnosis is not performed. Since the counting time of the timer does not become equal to or more than "X6 [msec]", reservation of an abnormality diagnosis is also not performed. Therefore, in this case, the valve control of the multi-way valve 4 is not prohibited.

Since the valve control is not prohibited and the provisional abnormality flag is "OFF" in this way, normal control is selected as the control manner of the valve body 404 through the valve control switching process (FIG. 8). Therefore, after time t80, when the target relative angle is changed as shown by a broken line, the duty cycle is changed through PI control, so that the relative angle of the valve body 404 changes to approach the changed target relative angle.

In this way, in the ECU 500, when the fixation is eliminated by the shake-off control before the abnormality diagnosis is finalized, the control manner of the multi-way valve 4 is returned to the normal control. Since the abnormality diagnosis is not performed when the fixation is eliminated by the shake-off control, it is avoided that the warning lamp 130 is turned on and that the valve control of the multi-way valve 4 is prohibited. Further, since the output limitation process is ended, the state where the output of the internal combustion engine 1 is limited is eliminated.

According to the embodiment described above, the following effects are obtained. (1) When the provisional abnormality flag is set to "ON", i.e. when it is determined by the fixation determination unit 503 that the valve body 404 is fixed, the shake-off control is performed. When the shake-off control is performed in this way so that the valve body 404 is driven to move even slightly, there is a possibility that the foreign matter jammed between the housing 400 and the valve body 404 or jammed in the gears 409 between the valve body 404 and the motor 408 may come off. If the jammed foreign matter comes off in this way, the fixation of the valve body 404 is eliminated, so that the valve body 404 of the multi-way valve 4 can be adequately controlled. Therefore, it can be prevented that the flow rate of the cooling liquid cannot be adequately controlled due to the fixation of the valve body 404.

(2) The fixation determination unit 503 makes a determination of the fixation on condition that the state where the rotation angle (amount of movement) of the valve body 404 for the predetermined time period (X1 [msec]) is less than "X3 [°]" is continued for the certain time period until the count of the counter becomes equal to or more than "X4". This makes it possible to prevent that the fixation determination unit 503 erroneously makes a determination of the occurrence of fixation due to the phenomenon that an amount of movement of the valve body 404 calculated from a signal that is output from the position sensor 407 increases or decreases instantaneously due to the influence of noise.

(3) The fixation determination unit 503 makes a determination as to whether or not the valve body 404 is fixed, on condition that, as one of its conditions, the duty cycle is equal to or more than "X2 [%]" in order to determine that the torque of the motor 408 is equal to or more than a predetermined amount. The duty cycle at which the rotational speed of the valve body 404 surely becomes greater than "X3/X1 [°/msec]" unless fixation is occurring is set as "X2 [%]". By adding the torque of the motor 408 being equal to or more than the predetermined amount as the condition for determining the fixation, the determination of the fixation is performed more strictly.

(4) In the shake-off control, the motor control unit 502 controls energization to the motor 408 with the duty cycle greater than that in the normal control, thereby producing a torque greater than a torque that is produced when it is not determined that the valve body 404 is fixed. When the fixation has occurred, the valve body 404 of the multi-way valve 4 does not easily move. By driving the motor 408 with the greater duty cycle in this way, the valve body 404 tends to be moved by the shake-off control even when the fixation is occurring, so that the fixation tends to be eliminated.

(5) When first driving the valve body 404 in the shake-off control, the valve body 404 is driven in the direction opposite to the driving direction when the provisional abnormality flag was set from "OFF" to "ON", i.e. when a determination of jamming of the foreign matter (fixation) of the valve body 404 was made. Consequently, the force holding the foreign matter is relaxed, so that the foreign matter tends to come off early. Therefore, the fixation tends to be eliminated.

(6) In the shake-off control, the driving of the valve body 404 is repeated while sandwiching the time period during which energization to the motor 408 is stopped to stop the driving of the valve body 404. Consequently, the time period during which the force holding the foreign matter is relaxed and does not act is provided, so that the jammed foreign matter comes off more easily.

(7) In the shake-off control, energization to the motor 408 is controlled such that the driving of the valve body 404 in the plus direction and the driving of the valve body 404 in the minus direction are carried out alternately. Consequently, there is a possibility that the foreign matter that did not easily come off when driving in one direction may come off when driving in the other direction. Therefore, the fixation tends to be eliminated.

(8) In the shake-off control, when the relative opening degree is in the limit region so that the distance to the stopper 413 in one of the rotational directions of the valve body 404 is less than the predetermined distance, energization to the motor 408 is controlled to drive the valve body 404 in the other direction, while energization to the motor 408 to drive the valve body 404 in the one direction is prohibited. Consequently, when the distance from the engaging portion 406 of the valve body 404 to the stopper 413 is short, the valve body 404 is not driven toward the stopper 413 side in the shake-off control. Therefore, it is possible to avoid a collision between the engaging portion 406 and the stopper 413 when the fixation is eliminated.

(9) Since the amount of movement for the predetermined time period (X1 [msec]) is monitored even during the shake-off control, when the fixation is eliminated through the shake-off control so that the amount of movement for the predetermined time period (X1 [msec]) becomes large, a determination of the elimination of the fixation can be made.

(10) When the fixation determination unit 503 has determined that the fixation of the valve body 404 is eliminated, the motor control unit 502 ends the shake-off control. This makes it possible to quickly restart the normal control to control the flow rate of the cooling liquid.

(11) The output limitation process to limit the output of the internal combustion engine 1 is performed when the shake-off control is being performed based on a determination that the valve body 404 is fixed. Consequently, the amount of the cooling liquid discharged from the engine-driven cooling liquid pump 13 is limited. As a result, even when the fixation of the valve body 404 of the multi-way valve 4 is occurring, it is prevented that the pressure of the cooling liquid in the circulation path becomes excessively high.

(12) When the shake-off control is performed, the fixation may be eliminated. Therefore, after the shake-off control is started by the motor control unit 502, the output limitation process to limit the output of the internal combustion engine 1 is started when the shake-off control is being performed. Consequently, when the fixation is eliminated by the shake-off control before the start of the output limitation process, the output limitation process is not performed. Therefore, it can be prevented that the output limitation process is performed unnecessarily.

(13) In the output limitation process, the output of the internal combustion engine 1 is limited according to a position of the valve body 404 when the output limitation process is started based on a signal output from the position sensor 407 that detects the position of the valve body 404. Consequently, the output of the internal combustion engine 1 can be limited by acquiring the state of the multi-way valve 4 according to the position of the valve body 404 and matching with the relative angle of the valve body 404 of the multi-way valve 4. Therefore, by performing the output limitation process, it is possible to prevent the pressure of the cooling liquid in the circulation path from becoming excessively high while preventing the output of the internal combustion engine 1 from being excessively limited.

(14) When the shake-off control by the motor control unit 502 is continued for the certain time period (X6 [msec]), the signal output unit 505 outputs a signal that causes the warning lamp 130 to carry out notification. Consequently, when the fixation is not eliminated even when the shake-off control is continued for the certain time period (X6 [msec]), an abnormality is notified, so that it is possible to prompt the maintenance.

(15) When the cooling liquid is frozen, there is a possibility that the valve body 404 does not move even when foreign matter or the like is not jammed, so that it may be determined by the fixation determination unit 503 that the valve body 404 is fixed. When the valve body 404 does not move due to freezing, the fixation is eliminated following a rise in temperature of the internal combustion engine 1 or in atmospheric temperature. If an abnormality is notified even in the case of the fixation due to freezing which may be eliminated following a rise in temperature of the internal combustion engine 1 or in atmospheric temperature, the frequency of prompting the maintenance becomes unnecessarily high, resulting in lowering of reliability. Therefore, when the temperature of the cooling liquid acquired by the temperature acquisition unit 504 is a temperature indicative of freezing of the cooling liquid, an abnormality diagnosis is reserved and thus a signal that causes the warning lamp 130 to carry out notification is not output. Consequently, since an abnormality is not notified when there is a possibility of the fixation due to freezing, the lowering of reliability described above can be prevented. When the abnormality diagnosis is reserved, while the valve control is prohibited and the output limitation process is continued, the final abnormality flag is not set to "ON". Therefore, as described above, when, after the engine operation has finished so that energization to the ECU 500 is stopped, the engine operation is started again, various controls described above with reference to FIGS. 8 to 17 are performed in the state where the prohibition of the valve control and the output limitation process are released. Accordingly, in the case where the freezing of the cooling liquid is eliminated when the engine operation is started again, the multi-way valve 4 is controlled by the normal control, so that the state where the valve control is prohibited and the state where the output limitation process is performed are not continued unnecessarily.

The above-described embodiment can be changed as follows. In the above-described embodiment, the fixation determination unit 503 acquires the position of the valve body 404 of the multi-way valve 4 by the position sensor 407 and makes a determination of the fixation on condition that the rotation angle (amount of movement) of the valve body 404 for the predetermined time period (X1 [msec]) is less than "X3 [°]", but the disclosure is not limited thereto. The length of the predetermined time period and the magnitude of the rotation angle (amount of movement) used as the threshold value for determination can be changed as appropriate. Further, for example, the fixation determination unit 503 may determine that the valve body 404 is fixed when a state where a deviation between a target position of the valve body 404 in feedback control by the motor control unit 502 and a position of the valve body 404 acquired from a signal output from the position sensor 407 is equal to or more than a reference amount is continued for a certain time period. When the fixation is occurring, the valve body 404 does not easily move toward the target position. Therefore, even when the feedback control is performed, the state where the target position of the valve body 404 and the position of the valve body 404 acquired from the signal output from the position sensor 407 deviate from each other continues. Therefore, even with the configuration described above, it is possible to determine whether or not the valve body 404 is fixed. Another embodiment of the disclosure that performs determination different from that in the above-described embodiment will be described next.

Figure 20:
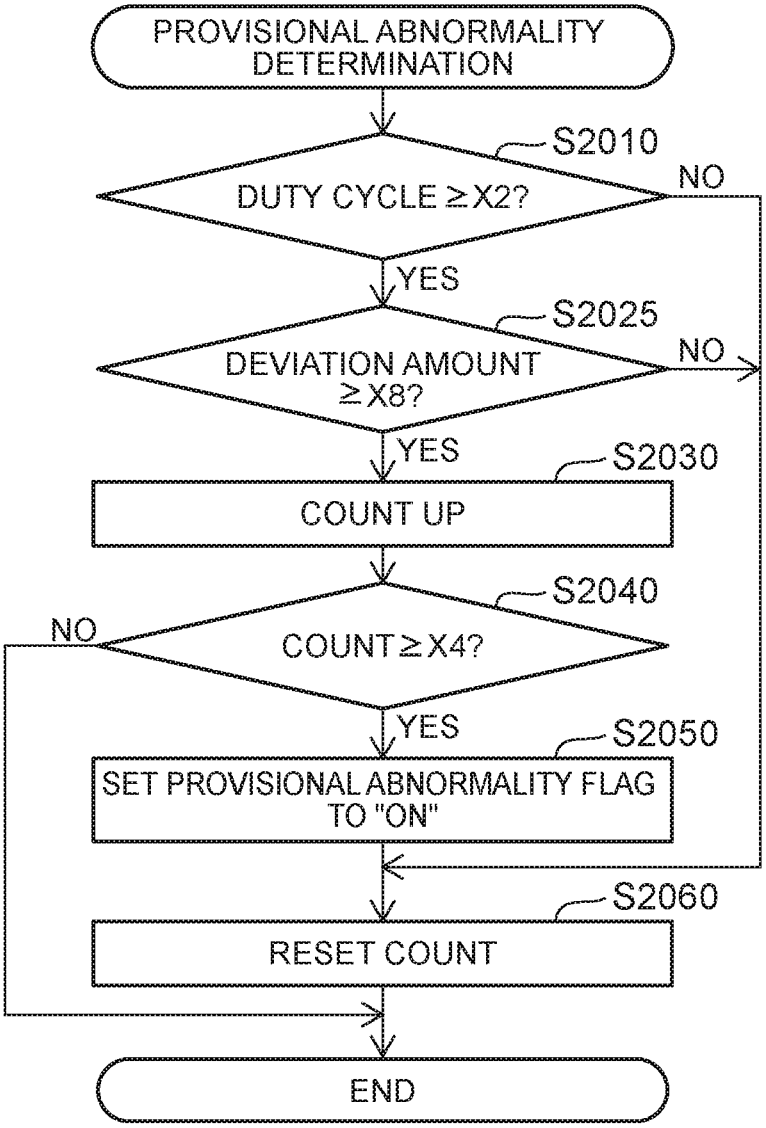
FIG. 20 is a flowchart showing the flow of a provisional abnormality determination process executed by an ECU according to an embodiment different from the above-described embodiment of the disclosure.

In specific determination in this another embodiment, a provisional abnormality determination process to determine whether or not the valve body 404 is fixed is performed by replacing step S2020, described above with reference to FIG. 9, with step S2025 which will be described hereinbelow. In this case, as shown in FIG. 20, at step S2025, the fixation determination unit 503 calculates a deviation amount between a relative angle as a target value of the valve body 404 in feedback control by the motor control unit 502 and a relative angle of the valve body 404 acquired by the position sensor 407. The fixation determination unit 503 determines whether or not the deviation amount is equal to or more than a reference value, "X8 [°]". When the deviation amount is less than the reference value, "X8 [°]" (step S2025: NO), the fixation determination unit 503 resets the count at step S2060 and ends this provisional abnormality determination process. On the other hand, when the deviation amount is equal to or more than the reference value, "X8 [°]" (step S2025: YES), the fixation determination unit 503 causes the process to proceed to step S2030 and performs count-up.

In the above-described embodiment, after the valve body 404 is determined to be fixed, when the rotation angle (amount of movement) of the valve body 404 for the predetermined time period (X1 [msec]) is equal to or more than "X3 [°]", the fixation of the valve body 404 is determined to be eliminated, but the disclosure is not limited to only this condition. The length of the predetermined time period and the magnitude of the rotation angle (amount of movement) used as the threshold value for determination can be changed as appropriate. For example, a relative angle of the valve body 404 to the housing 400 when the valve body 404 was determined to be fixed and a relative angle of the valve body 404 to the housing 400 thereafter may be compared with each other, and when it is determined that a predetermined amount or more has been changed from the relative angle when the determination of the fixation was made, it may be determined that the fixation of the valve body 404 is eliminated. Further, for example, when the state where the rotation angle (amount of movement) of the valve body 404 for the predetermined time period (X1 [msec]) is equal to or more than "X3 [°]" is continued for a certain time period longer than the predetermined time period (X1 [msec]), it may be determined that the fixation of the valve body 404 is eliminated. According to this configuration, since the fixation is determined to be eliminated when the state where the amount of movement is large is continued for a certain time period, it is possible to prevent an erroneous determination that is caused by an instantaneous change of the amount of movement due to noise or the like. In short, if it can be confirmed that the valve body 404 has moved a predetermined amount or more, it can be determined that the fixation is eliminated.

In the above-described embodiment, the fixation determination unit 503 makes a determination of the fixation on condition that the state where the amount of movement of the valve body 404 for the predetermined time period is less than the reference value is continued for the certain time period longer than the predetermined time period, but the disclosure is not limited thereto. For example, when the amount of movement of the valve body 404 for the predetermined time period is less than the reference value, the fixation determination unit 503 may immediately determine that the valve body 404 is fixed.

In the above-described embodiment, the fixation determination unit 503 makes a determination as to whether or not the valve body 404 is fixed, on condition that, as one of its conditions, the duty cycle is equal to or more than "X2 [%]" in order to reflect, as one of its conditions, that the torque of the motor 408 is equal to or more than a predetermined amount. However, a determination of the fixation may be made without adding such a condition about the torque of the motor 408.

In the above-described embodiment, in the shake-off control, the motor control unit 502 controls energization to the motor 408 to produce a torque greater than a torque that is produced when it is not determined that the valve body 404 is fixed, but the disclosure is not limited thereto. For example, in the shake-off control, the motor 408 may be driven by a torque within a torque range that is realized in the normal control when it is not determined that the valve body 404 is fixed.

In the above-described embodiment, the direction in which the motor control unit 502 first drives the valve body 404 in the shake-off control is the direction opposite to the driving direction when the valve body 404 was determined to be fixed, but the disclosure is not limited thereto. For example, the driving direction when the valve body 404 was determined to be fixed and the direction in which the valve body 404 is first driven in the shake-off control may be set to the same direction.

In the above-described embodiment, in the shake-off control, the driving of the valve body 404 is repeated while sandwiching the time period during which energization to the motor 408 is stopped to stop the driving of the valve body 404. However, such a time period for stopping the driving of the valve body 404 is not necessarily provided. Further, when providing the time period for stopping the driving, the time period for stopping the driving is not necessarily provided between the driving in the plus direction and the driving in the minus direction. For example, the time period for stopping the driving may be provided after continuously performing the driving in the plus direction and the driving in the minus direction, and thereafter, the driving may be restarted.

In the above-described embodiment, in the shake-off control, energization to the motor 408 is controlled such that the driving of the valve body 404 in the plus direction and the driving of the valve body 404 in the minus direction are carried out alternately. However, the driving in the plus direction and the driving in the minus direction are not necessarily carried out alternately. For example, it is possible to employ a configuration to repeat driving in one direction and driving in the same direction while sandwiching therebetween a time period for stopping the driving, or a configuration to repeat driving in the same direction a plurality of times while sandwiching therebetween a time period for stopping the driving, and then driving in the other direction.

In the above-described embodiment, in the shake-off control, when the distance from the engaging portion 406 of the valve body 404 to the stopper 413 in one of the rotational directions of the valve body 404 is less than the predetermined distance, energization to the motor 408 to drive the valve body 404 in the one direction is prohibited, but is not necessarily prohibited. That is, both-side shake-off control may always be performed in the shake-off control.

In the above-described embodiment, when the fixation determination unit 503 has determined that the fixation of the valve body 404 is eliminated, the shake-off control is ended, but the disclosure is not limited thereto. For example, after the fixation determination unit 503 has determined that the fixation of the valve body 404 is eliminated, the shake-off control may be continued for a predetermined time period. Even when the fixation determination unit 503 has determined that the fixation of the valve body 404 is eliminated, there may be a case where foreign matter jammed between the housing 400 and the valve body 404, or the like has not completely come off. In such a situation, there is a possibility that the foreign matter may completely come off by continuing the shake-off control for a while even after the fixation of the valve body 404 is determined to be eliminated.

In the above-described embodiment, the output limitation process of the internal combustion engine 1 is performed when the shake-off control is being performed. However, the output limitation process is not necessarily performed. ● In the above-described embodiment, the output limitation process of the internal combustion engine 1 is performed after the shake-off control is started, but the disclosure is not limited thereto. For example, when the provisional abnormality flag is set to "ON", the output limitation process of the internal combustion engine 1 may be started immediately.

In the above-described embodiment, the output limitation process of the internal combustion engine 1 is performed according to the relative angle of the valve body 404 after the provisional abnormality flag is set to "ON", but the disclosure is not limited thereto. For example, even before the provisional abnormality flag is set to "ON", when the fixation has occurred and the valve body 404 does not easily rotate in a state of a small relative angle of the valve body 404, there is a possibility that the pressure in the circulation path may become high. In this case, upon confirmation that the rotational speed of the valve body 404 is low, i.e. the valve body 404 does not easily rotate, the output limitation process of the internal combustion engine 1 may be performed before the provisional abnormality flag is set to "ON".

In the above-described embodiment, in the output limitation process, an upper limit rotational speed of the engine rotational speed is calculated according to a relative angle of the valve body 404, thereby controlling the engine rotational speed so as not to exceed the calculated upper limit rotational speed, but the disclosure is not limited thereto. For example, as shown by the two-dot chain line in FIG. 15, the constant upper limit rotational speed may be set regardless of the relative angle of the valve body 404, thereby controlling the engine rotational speed so as not to exceed the constant upper limit rotational speed.

In the above-described embodiment, the description has been given of the configuration in which the warning lamp 130 is provided as the notification device and in which when the final abnormality flag is set to "ON", the warning lamp 130 is turned on to notify the occurrence of an abnormality. However, the occurrence of an abnormality is not necessarily notified. For example, an abnormality may be perceived from a change in behavior due to the output limitation process or the like. If the abnormality is perceived in this way so that the state of the final abnormality flag stored in the backup memory is confirmed when carrying out the maintenance, it is possible to confirm whether or not an abnormality diagnosis of the multi-way valve 4 is finalized, so that the maintenance can be carried out.

The notification device is not limited to the warning lamp 130. For example, a speaker or the like that notifies the occurrence of an abnormality by voice or sound may be provided.

In the above-described embodiment, when the temperature of the cooling liquid is less than "X7 [° C.]", the final abnormality flag is not set to "ON", and an abnormality diagnosis is reserved, i.e. not finalized, but the disclosure is not limited thereto. For example, regardless of the temperature of the cooling liquid, when the shake-off control is continued for a certain time period, the final abnormality flag may be set to "ON" to finalize an abnormality diagnosis. If it is possible to determine whether or not the cooling liquid is frozen, the temperature of the cooling liquid may be estimated based on an outside air temperature detected by the outside air temperature sensor 124, not depending on a temperature of the cooling liquid detected by the outlet liquid temperature sensor 15, thereby reserving an abnormality diagnosis.

In the above-described embodiment, the output limiting unit 506 starts and resets the timer based on the provisional abnormality flag, and the final abnormality determination process is performed based on the counting time of the timer, but the disclosure is not limited thereto. For example, another processing unit in the ECU 500 may start and reset the timer. With this configuration, even a control system for an internal combustion engine including no output limiting unit 506 can perform final abnormality determination on fixation of a valve body 404 based on the counting time of a timer.

The multi-way valve 4 having three ports is shown as the control valve by way of example. In the case of a control valve in which a valve body moves in a housing, not limited to a control valve having a plurality of ports, the same problem can occur, and therefore, the same configuration as the above-described embodiment can be applied to a control system for an internal combustion engine as long as it controls a control valve in which a valve body moves in a housing. A valve body is not limited to one that rotates in a housing, and may alternatively be one that slides linearly in a housing.

What is claimed is:

1. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, (iii) perform fixation-time control that energizes the motor so as to drive the valve body, when the electronic control unit determines that the valve body is fixed, (iv) acquire an amount of movement of the valve body from a signal that is output from a sensor that detects a position of the valve body, (v) determine that the valve body is fixed based on the amount of movement of the valve body for a predetermined time period being less than a reference value, and (vi) determine that the valve body is fixed when a predetermined state is continued for a certain time period longer than the predetermined time period, and the predetermined state is a state in which the amount of movement of the valve body for the predetermined time period is less than the reference value.

2. The control system according to claim 1, wherein the predetermined state is a state in which a torque of the motor is equal to or more than a predetermined amount and the amount of movement of the valve body for the predetermined time period is less than the reference value.

3. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, (iii) perform fixation-time control that energizes the motor so as to drive the valve body, when the electronic control unit determines that the valve body is fixed, (iv) acquire a signal that is output from a sensor that detects a position of the valve body, and perform feedback control that controls energization to the motor so as to cause the position of the valve body to coincide with a target position, and (v) acquire a signal that is output from the sensor that detects the position of the valve body, to thereby acquire the position of the valve body, and determine that the valve body is fixed when a predetermined state is continued for a certain time period, and the predetermined state is a state in which a deviation between the target position in the feedback control and the position acquired from the signal that is output from the sensor is equal to or more than a reference amount.

4. The control system according to claim 1, wherein the electronic control unit is configured to control energization to the motor so as to produce a torque greater than a torque that is produced when the electronic control unit determines that the valve body is not fixed, in the fixation-time control.

5. The control system according to claim 1, wherein the valve body moves in a first direction or a second direction opposite to the first direction in the housing, and the electronic control unit is configured to control energization to the motor such that driving of the valve body in the first direction and driving of the valve body in the second direction are performed alternately, in the fixation-time control.

6. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, and (iii) perform fixation-time control that energizes the motor so as to drive the valve body, when the electronic control unit determines that the valve body is fixed, wherein the valve body moves in a first direction or a second direction opposite to the first direction in the housing, and when the electronic control unit starts the fixation-time control, the electronic control unit is configured to control energization to the motor so as to drive the valve body in a direction that is opposite to a direction when the electronic control unit determines that the valve body is fixed, among the first direction and the second direction.

7. The control system according to claim 6, wherein the valve body moves in the first direction or the second direction opposite to the first direction in a predetermined range until abutting a stopper in the housing, and the electronic control unit is configured to: when the electronic control unit starts the fixation-time control and a distance from the valve body to the stopper in one of the first direction and the second direction is less than a predetermined distance, (i) not perform the process to control energization to the motor so as to drive the valve body in a direction that is opposite to a direction when the electronic control unit determines that the valve body is fixed, among the first direction and the second direction, and control energization to the motor so as to drive the valve body in the other of the first direction and the second direction, in the fixation-time control, and (ii) not perform the process to control energization to the motor so as to drive the valve body in a direction that is opposite to a direction when the electronic control unit determines that the valve body is fixed, among the first direction and the second direction, and control energization to the motor so as not to drive the valve body in the one of the first direction and the second direction, in the fixation-time control.

8. The control system according to claim 1, wherein the valve body moves in a first direction or a second direction opposite to the first direction in a predetermined range until abutting a stopper in the housing, and the electronic control unit is configured to: when the electronic control unit starts the fixation-time control and a distance from the valve body to the stopper in one of the first direction and the second direction is less than a predetermined distance, (i) control energization to the motor so as to drive the valve body in the other of the first direction and the second direction, in the fixation-time control, and (ii) control energization to the motor so as not to drive the valve body in the one of the first direction and the second direction, in the fixation-time control.

9. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, (iii) perform fixation-time control that energizes the motor so as to drive the valve body, when the electronic control unit determines that the valve body is fixed, (iv) acquire an amount of movement of the valve body from a signal that is output from a sensor that detects a position of the valve body, after the electronic control unit determines that the valve body is fixed, and (v) determine that fixation of the valve body is eliminated when the amount of movement of the valve body for a predetermined time period becomes greater than a reference value.

10. The control system according to claim 9, wherein the electronic control unit is configured to end the fixation-time control when the electronic control unit determines that the fixation of the valve body is eliminated.

11. The control system according to claim 9, wherein the electronic control unit is configured to determine that fixation of the valve body is eliminated when a predetermined state is continued for a certain time period longer than the predetermined time period, and the predetermined state is a state in which the amount of movement of the valve body for the predetermined time period is greater than the reference value.

12. The control system according to claim 11, wherein the electronic control unit is configured to end the fixation-time control when the electronic control unit determines that the fixation of the valve body is eliminated.

13. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, (iii) perform fixation-time control that energizes the motor so as to drive the valve body, when the electronic control unit determines that the valve body is fixed, the pump is an engine-driven pump that is driven by an output shaft of the internal combustion engine, and the electronic control unit is configured to:

(i) (iv) perform an output limitation process which limits an output of the internal combustion engine, and (v) perform the output limitation process when the fixation-time control is being performed.

14. The control system according to claim 13, wherein the electronic control unit is configured to:

(i) start the output limitation process after a lapse of a predetermined time from start of the fixation-time control while the fixation-time control is being performed, and (ii) end the fixation-time control when the electronic control unit determines that fixation of the valve body is eliminated.

15. The control system according to claim 13, wherein the electronic control unit is configured to:

(i) acquire a position of the valve body from a signal that is output from a sensor that detects the position of the valve body, in the output limitation process, and (ii) limit the output of the internal combustion engine according to the position of the valve body when the electronic control unit starts the output limitation process.

16. The control system according to claim 1, wherein the electronic control unit is configured to:

(i) output a signal that causes a notification device, that notifies an abnormality of the control valve, to perform notification, and (ii) output a signal that causes the notification device to perform notification when the fixation-time control is continued for a certain time period.

17. A control system for an internal combustion engine, the internal combustion engine provided with a cooling system, the cooling system including:

a pump configured to circulate a cooling liquid in a circulation path of the internal combustion engine, and a control valve configured to control a flow of the cooling liquid in the circulation path by driving a valve body housed in a housing, with a motor, the control system comprising:

an electronic control unit configured to:

(i) control energization to the motor, (ii) make a determination on fixation of the valve body, (iii) perform fixation-time control that energizes the motor so as to drive the valve body, when the electronic control unit determines that the valve body is fixed, (iv) output a signal that causes a notification device, that notifies an abnormality of the control valve, to perform notification, (v) output a signal that causes the notification device to perform notification when the fixation-time control is continued for a certain time period, (vi) acquire a temperature of the cooling liquid, and (vii) not output the signal that causes the notification device to perform notification when the acquired temperature of the cooling liquid is a temperature indicative of freezing of the cooling liquid even when the fixation-time control is continued for the certain time period.

18. The control system according to claim 1, wherein the electronic control unit is configured to control energization to the motor such that a time period during which energization to the motor is stopped to stop driving of the valve body and a time period during which the motor is energized to drive the valve body are repeated alternately, in the fixation-time control.

* * * * *